US007834556B2

(12) United States Patent
Yamamoto et al.

(10) Patent No.: US 7,834,556 B2
(45) Date of Patent: Nov. 16, 2010

(54) DRIVING METHOD FOR ORGANIC ELECTROLUMINESCENCE LIGHT EMITTING SECTION

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 327 days.

(21) Appl. No.: 12/076,158

(22) Filed: Mar. 14, 2008

(65) Prior Publication Data

US 2008/0231200 A1 Sep. 25, 2008

(30) Foreign Application Priority Data

Mar. 20, 2007 (JP) ..... 2007-072503

(51) Int. Cl.
*G09G 3/10* (2006.01)

(52) U.S. Cl. ..... 315/169.1; 315/169.3; 345/76; 345/80; 345/211

(58) Field of Classification Search ..... 345/45, 345/55, 56, 76–80, 211; 315/169.1, 169.3
See application file for complete search history.

(56) References Cited

U.S. PATENT DOCUMENTS 7,327,335 B2 * 2/2008 Yamazaki et al. ..... 345/76
7,432,888 B2 * 10/2008 Kwak ..... 345/76
2008/0231199 A1 * 9/2008 Yamamoto et al. ..... 315/169.3
2009/0046088 A1 * 2/2009 Asano et al. ..... 345/211

FOREIGN PATENT DOCUMENTS

JP 2006-215213 * 8/2006

* cited by examiner

*Primary Examiner*—Haissa Philogene
(74) *Attorney, Agent, or Firm*—Rader, Fishman & Grauer PLLC

(57) ABSTRACT

A driving method for an organic electroluminescence light emitting section using a driving circuit, the driving circuit includes a driving transistor, an image signal writing transistor, a light emission control transistor, and a capacitor section. The driving method includes the steps of: carrying out a preprocess of applying a first node initialization voltage and applying a second node initialization voltage; carrying out a threshold voltage cancellation process; placing the light emission control transistor into an on state, a writing process of applying an image signal; and placing the image signal writing transistor into an off state so that current is supplied to the organic electroluminescence light emitting section to drive the organic electroluminescence light emitting section.

3 Claims, 17 Drawing Sheets

[TP(5)$_{-1}$]

[TP(5)$_1$]

[TP(5)$_1$] (CONTINUED)

[TP(5)$_2$]

[TP(5)$_3$]

[TP(5)$_4$]

[TP(5)$_5$]

[TP(5)$_6$]

[TP(5)$_7$]

[TP(4)$_{-1}$]

[TP(4)$_{1}$]

[TP(4)$_{2}$]

[TP(4)$_{3}$]

[TP(4)$_4$]

[TP(4)$_5$]

[TP(4)$_6$]

[TP(4)$_7$]

[TP(3)$_{-1}$]

[TP(3)$_0$]

[TP(3)$_1$]

[TP(3)$_2$]

[TP(3)$_3$]

[TP(3)$_4$]

[TP(3)$_5$]

[TP(3)$_6$]

[TP(3)$_7$]

DRIVING METHOD FOR ORGANIC ELECTROLUMINESCENCE LIGHT EMITTING SECTION

CROSS REFERENCES TO RELATED APPLICATIONS

The present invention contains subject matter related to Japanese Patent Application JP 2007-072503 filed with the Japan Patent Office on Mar. 20, 2007, the entire contents of which are incorporated herein by reference.

BACKGROUND OF THE INVENTION

1. Field of the Invention

This invention relates to a driving method for an organic electroluminescence light emitting section.

2. Description of the Related Art

In an organic electroluminescence display apparatus, (herein after referred to simply as organic EL display apparatus) wherein an organic electroluminescence device (hereinafter referred to simply as organic EL element) is used as a light emitting element, the luminance of the organic EL element is controlled by the values of current which flows through the organic EL element. Then, similar to a liquid crystal display apparatus, and also in an organic EL display apparatus, the use of a simple matrix and the active matrix method are well known driving methods. While the active matrix method has a drawback due to its complicated structure when compared to the simple matrix method, the active matrix method has such various advantages that allows the luminance of an image to be increased.

As a circuit for driving an organic electroluminescence light emitting section (hereinafter referred to simply as light emitting section) which forms an organic EL element, a driving circuit (hereinafter referred to as 5Tr/1C driving circuit) composed of five transistors and one capacitor section is well known and disclosed, for example, in Japanese Patent Laid-Open No. 2006-215213. Referring to FIG. 1, the existing 5Tr/1C driving circuit mentioned is shown. The 5Tr/1C driving circuit includes five transistors of an image signal writing transistor $T_{Sig}$, a driving transistor $T_{Drv}$, a light emission control transistor $T_{EL_C}$, a first node initialization transistor $T_{ND1}$, a second node initialization transistor $T_{ND2}$, and one capacitor section $C_1$. Here, the other end of the source/drain regions of the driving transistor $T_{Drv}$ forms a second node $ND_2$, and the gate electrode of the driving transistor $T_{Drv}$ forms the first node $ND_1$.

The Transistors and the capacitor section are hereinafter described in detail.

For example, the transistors are individually formed from an n-channel thin film transistor (TFT), and a light emitting section ELP is provided on an interlayer insulating layer, or the like, formed so as to cover the driving circuit. The anode electrode of the light emitting section ELP is connected to the other one of the source/drain regions of the driving transistor $T_{Drv}$. A voltage $V_{Cat}$, for example 0 volt, is applied to the cathode electrode of the light emitting section ELP. Reference character $C_{EL}$ denotes parasitic capacitance of the light emitting section ELP.

A timing chart of driving is schematically shown in FIG. 17. A preprocess for carrying out a threshold voltage cancellation process is executed within a [period—TP(5)$_1$]. In particular, if the first node initialization transistor $T_{ND1}$ and the second initialization transistor $T_{ND2}$ are placed into the on state, the potential at the first node $ND_1$ becomes $V_{Ofs}$, for example 0 volt, and the potential at the second node $ND_2$ becomes $V_{SS}$, for example −10 volts. Consequently, the potential difference between the gate electrode of the driving transistor $T_{Drv}$ and the other end of the source/drain regions (hereinafter referred to as source region for the convenience of description) of the driving transistor $T_{Drv}$ becomes higher than a threshold voltage $V_{th}$ of the driving transistor $T_{Drv}$, placing the driving transistor $T_{Drv}$ into an on state.

The threshold voltage cancellation process is then carried out within the [period—TP(5)$_2$]. In particular, the light emission control transistor $T_{EL_C}$ is placed into an on state, while the on state of the first node initialization transistor $T_{ND1}$ is maintained. As a result, the potential at the second node $ND_2$ varies toward the potential difference between the threshold voltage $V_{th}$ of the driving transistor $T_{Drv}$ and the first node $ND_1$. In other words, the potential at the second node $ND_2$ in a floating state rises. When the potential difference between the gate electrode and the source region of the driving transistor $T_{Drv}$ reaches the threshold voltage $V_{th}$, the driving transistor $T_{Drv}$ then enters an off state. In this state, the potential at the second node $ND_2$ is approximately $V_{Ofs}-V_{th}$. Thereafter, within a [period—TP(5)$_3$], the light emission control transistor $T_{EL_C}$ is placed into an off state, while the on state of the first node initialization transistor $T_{ND1}$ is maintained. Then, the first node initialization transistor $T_{ND1}$ is placed into an off state within a [period—TP(5)$_4$].

Thereafter, a writing process for the driving transistor $T_{Drv}$ is executed within a [period—TP(5)$_5$']. In particular, during the off state of the first node initialization transistor $T_{ND1}$, the second node initialization transistor $T_{ND2}$ and the light emission control transistor $T_{EL_C}$ is maintained. The potential at a data line DTL is also set to a voltage corresponding to the image signal, that is, to the image signal (driving signal or luminance signal) voltage $V_{Sig}$ for controlling the luminance of the light emitting section ELP. A scanning line SCL is then placed into a high-level state so the image signal writing transistor $T_{Sig}$ is placed into an on state. As a result, the potential at the first node $ND_1$ increases to the image signal voltage $V_{Sig}$. Charge based on the variation amount of the potential of the first node $ND_1$ is distributed to each of the capacitor section $C_1$, the parasitic capacitance $C_{EL}$ of the light emitting section ELP, and the parasitic capacitance between the gate electrode and the source region of the driving transistor $T_{Drv}$. Accordingly, if the potential at the first node $ND_1$ varies, then the potential at the second node $ND_2$ also varies. However, the variation of the potential of the second node $ND_2$ decreases as the capacitance value of the parasitic capacity $C_{EL}$ of the light emitting section ELP increases. Generally, the capacitance value of the parasitic capacitance $C_{EL}$ of the light emitting section ELP is higher than the capacitance value of the capacitor section $C_1$ and the value of the parasitic capacitance of the driving transistor $T_{DRV}$. Therefore, if the potential of the second node $ND_2$ varies by a small amount, the potential difference $V_{gs}$ between the gate electrode and the other end of the source/drain regions of the driving transistor $T_{Drv}$ is given by the following expression (A):

$$V_{gs} \approx V_{Sig}-(V_{Ofs}-V_{th}) \quad \text{(A)}$$

Thereafter, correction, that is, a mobility correction process, of the potential in the source region of the driving transistor $T_{Drv}$, or at the second node $ND_2$, is carried out within a [period—TP(5)$_6$'] based on a characteristic, such as the magnitude of the mobility μ of the driving transistor $T_{Drv}$. In particular, the light emission control transistor $T_{EL_C}$ is placed into an on state while the on state of the driving transistor $T_{Drv}$ is maintained. Then, after a predetermined time period $t'_0$ passes, the image signal writing transistor $T_{Sig}$ is placed into an off state to place the first node $ND_1$, and hence the gate electrode of the driving transistor $T_{Drv}$, into a floating state. As a result, where the value of the mobility μ of the driving transistor $T_{Drv}$ is high, the increasing amount ΔV or potential correction value of the potential in the source region of the driving transistor $T_{Drv}$ becomes high. Where the value of the mobility μ of the driving transistor $T_{Drv}$ is low, however, the increasing amount ΔV or potential correction value of the potential in the source region of the driving transistor $T_{Drv}$ becomes low. Here, the potential difference $V_{gs}$ between the gate electrode and the source region of the driving transistor $T_{Drv}$ is transformed from the expression (A) into another expression (B) given below. It is to be noted that the predetermined time period, that is, the total time period $t'_0$ within the [period—TP(5)$_6$'] for executing the mobility correction process, may be determined in advance as a design value upon designing of the organic EL display apparatus.

$$V_{gs} \approx V_{Sig} - (V_{Ofs} - V_{th}) - \Delta V \quad \text{(B)}$$

By the operation described above, the threshold voltage cancellation process, writing process, and the mobility correction process are completed. Thereafter, within a [period—TP(5)$_7$], the image signal writing transistor $T_{Sig}$ is placed into an off state, and the first node $ND_1$, that is, the gate electrode of the driving transistor $T_{Drv}$, is placed into a floating state. On the other hand, the light emission control transistor $T_{EL_C}$ maintains the on state, and one of the source/drain regions (hereinafter conveniently referred to as drain region) of the light emission control transistor $T_{EL_C}$ is connected to a current supplying section of a voltage $V_{CC}$, for example, 20 volts for controlling light emission of the light emitting section ELP. As a result, the potential at the second node $ND_2$ increases, and a phenomenon similar to that in a bootstrap circuit occurs with the gate electrode of the driving transistor $T_{Drv}$, also increasing the potential at the first node $ND_1$. As a result, the potential difference $V_{gs}$ between the gate electrode and the source region of the driving transistor $T_{Drv}$ maintains a same value as obtained from the expression (B). Further, since current that flows through the light emitting section ELP is the drain current $I_{ds}$, which also flows from one of the source/drain regions (hereinafter conveniently referred to as drain region) of the driving transistor $T_{Drv}$ to the source region, the current can be represented by an expression (C). The light emitting section ELP emits light with the luminance corresponding to the value of the drain current $I_{ds}$. It is to be noted that a coefficient k is hereinafter described.

$$\begin{aligned} I_{ds} &= k \cdot \mu \cdot (V_{gs} - V_{th})^2 \\ &= k \cdot \mu \cdot (V_{Sig} - V_{ofs} - \Delta V)^2 \end{aligned} \quad \text{(C)}$$

The 5Tr/1C driving circuit whose outline is described above are hereinafter described in detail.

SUMMARY OF THE INVENTION

Incidentally, the light emitting control transistor $T_{EL_C}$ and the driving transistor $T_{Drv}$ is in an off state immediately before the [period—TP(5)$_5$']. Also within the [period—TP(5)$_5$'], the light emitting control transistor $T_{EL_C}$ is in an off state. Accordingly, the other end of the source/drain regions (hereinafter referred to as source region for the convenience of description) of the light emitting control transistor $T_{EL_C}$ and the drain region of the driving transistor $T_{Drv}$ (hereinafter referred to as third node $ND_3$) are in a state wherein they are not electrically connected to the current supplying section 100.

Within the [period—TP(5)$_5$'], an image signal $V_{Sig}$ according to the luminance of an image to be displayed is applied to the gate electrode of the driving transistor $T_{Drv}$. At this time, the potential at the third node $ND_3$ varies due to coupling by the parasitic capacitance between the gate electrode and the drain region of the driving transistor $T_{Drv}$. Accordingly, the potential at the third node $ND_3$ at an ending timing of the [period—TP(5)$_5$'] has a value corresponding to the value of the image signal $V_{Sig}$ applied to the gate electrode of the driving transistor $T_{Drv}$.

Then, at a starting timing of a [period—TP(5)$_6$'], the light emitting control transistor $T_{EL_C}$ is placed into an on state. At this time, the potential at the third node $ND_3$ rises from the value corresponding to the image signal $V_{Sig}$ described above to the voltage $V_{CC}$ of the current supplying section. Accordingly, the amount in variation of the potential at the third node $ND_3$ at this time relies upon the value of the image signal $V_{Sig}$.

On the other hand, parasitic capacitance also exits between the source region and the gate electrode of the light emitting control transistor $T_{EL_C}$. Thus, variation occurs with the potential at the gate electrode of the light emitting control transistor $T_{EL_C}$ due to the coupling between the source region and the gate electrode of the light emitting control transistor $T_{EL_C}$. As described above, the amount in variation of the potential at the third node $ND_3$ at a starting timing of the [period—TP(5)$_6$'] relies upon the value of the image signal $V_{Sig}$. Accordingly, the degree of the variation of the potential at the gate of the light emitting control transistor $T_{EL_C}$ also varies in response to the value of the image signal $V_{Sig}$.

As described above, at a starting timing of the [period—TP(5)$_5$'], variation occurs with the potential at the gate electrode of the light emitting control transistor $T_{EL_C}$ due to the coupling between the source region and the gate electrode of the light emitting control transistor $T_{EL_C}$ described above. As a result, variation occurs with the time length of the [period—TP(5)$_6$'], that is, with the time length of the mobility correction process. Therefore, there is a problem that the uniformity of the luminance of an image to be displayed is deteriorated.

Accordingly, a driving method is needed to provide an organic luminescence light emitting section which can suppress deterioration of the quality of a display screen image caused by variation of the time length of a mobility correction process.

According to the present embodiment, a driving method is provided for an organic electroluminescence light emitting section using a driving circuit, the driving circuit including:

(A) a driving transistor including source/drain regions, a channel formation region, and a gate electrode, (B) an image signal writing transistor including source/drain regions, a channel formation region, and a gate electrode, (C) a light emission control transistor including source/drain regions, a channel formation region, and a gate electrode, (D) a capacitor section having a pair of electrodes, and the driving transistor being configured such that (A-1) a first one of the source/drain regions is connected to a second one of the source/drain regions of the light emission control transistor (A-2) a second one of the source/drain regions is connected to an anode electrode provided in the organic electroluminescence light emitting section and is connected to a first one of the electrodes of the capacitor section to form a second node; and (A-3) the gate electrode is connected to a second one of the source/drain regions of the image signal writing transistor and is connected to a second one of the electrodes of the capacitor section to form a first node.

The image signal writing transistor being configured, such that:

(B-1) a first one of the source/drain regions is connected to a data line, and that (B-2) the gate electrode is connected to a scanning line.

The light emission control transistor being configured such that:

(C-1) a first one of the source/drain regions is connected to a current supplying section, and that (C-2) the gate electrode is connected to a light emission control transistor control line.

The driving method including the steps of:

(a) carrying out a preprocess of applying a first node initialization voltage to the first node, and applying a second node initialization voltage to the second node, so that a potential difference between the first and second nodes exceeds a threshold voltage of the driving transistor, and a potential difference between a cathode electrode of the organic electroluminescence light emitting section and the second node does not exceed a threshold voltage of the organic electroluminescence light emitting section;

(b) carrying out a threshold voltage cancellation process for varying the potential at the second node toward a potential difference between the threshold voltage of the driving transistor and the potential at the first node while the potential at the first node is maintained;

(c) placing the light emission control transistor into an on state and maintaining it while a signal from the light emission control transistor control line carries out a writing process of applying an image signal from the data line to the first node through the image signal writing transistor, placing it an on state the a signal from the scanning line; and (d) placing the image signal writing transistor into an off state with a signal from the scanning line to place the first node into a floating state. Thus, the current corresponding to the value of the potential difference between the first and second nodes is supplied from the current supplying section to the organic electroluminescence light emitting section through the driving transistor, driving the organic electroluminescence light emitting section.

In order to vary the potential at the second node during step (b) toward the potential difference between the threshold voltage of the driving transistor and the potential at the first node, while the potential at the first node is maintained, a voltage higher than the sum of the threshold voltage of the driving transistor and the potential at the second node at the step (a) should be applied from the current supplying section to the first one of the source/drain regions of the driving transistor.

The driving method for the organic electroluminescence light emitting section may be configured such that the driving circuit further includes:

(E) a second node initialization transistor including source/drain regions, a channel formation region, and a gate electrode.

The second node initialization transistor includes:

(E-1) a first one of the source/drain regions connected to a second node initialization voltage supply line;

(E-2) a second one of the source/drain regions connected to the second node; and (E-3) the gate electrode connected to a second node initialization transistor control line.

At step (a), a second node initialization voltage is applied from the second node initialization voltage supply line to the second node through the second node initialization transistor, which is placed in an on state with a signal from the second node initialization transistor control line, placing the second node initialization transistor into an off state with a signal from the second node initialization transistor control line.

In this instance, the driving method for the organic electroluminescence light emitting section may be further configured such that the driving circuit further includes:

(F) a first node initialization transistor including source/drain regions, a channel formation region, and a gate electrode:

in the first node initialization transistor:

(F-1) a first one of the source/drain regions connected to a first node initialization voltage supply line;

(F-2) a second one of the source/drain regions connected to the first node; and (F-3) the gate electrode connected to the first node initialization control line.

During step (a), a first node initialization voltage is applied from the first node initialization voltage supply line to the first node through the first node initialization transistor, which is placed in an on state with a signal from the first node initialization transistor control line.

Although details of the driving circuit are hereinafter described, the driving circuit can be formed from any of a driving circuit (hereinafter referred to as 5Tr/1C driving circuit) composed of five transistors and one capacitor section, or a driving circuit (hereinafter referred to as 4Tr/1C driving circuit) composed of four transistors and one capacitor section, or a driving circuit (hereinafter referred to as 3Tr/1C driving circuit) composed of three transistors and one capacitor section.

In the organic electroluminescence display apparatus, (organic EL display apparatus) to which the driving method of the present embodiment is applied, may have any of the known configurations and structures. Particularly, the configurations and structures include the current supplying section, a scanning circuit to which the scanning line is connected, an image signal outputting circuit to which the data line is connected, a light emission controlling transistor control circuit to which the light emission control transistor control line is connected, the scanning line, the data line, the light emitting transistor control line, and an organic electroluminescence light emitting section (which may be hereinafter referred to simply as light emitting section). In particular, the light emitting section may be composed of, for example, an anode electrode, a hole transport layer, a light emitting layer, an electron transport layer, a cathode electrode, etc.

In an organic EL display apparatus for color display, to which the driving method of the present embodiment is applied, one pixel includes a plurality of sub pixels. In particular, one pixel may have a form wherein it is composed of three sub pixels, including a red light emitting sub pixel, a green light emitting sub pixel, and a blue light emitting sub pixel. One pixel also may be composed of a set of sub pixels including such three sub pixels with either an additional one or of different sub pixels. For example, one pixel may additionally include a sub pixel for emitting white light for enhancing the luminance, a sub pixel or sub pixels for emitting light of a complementary color or colors for expanding the color reproduction range, a sub pixel for emitting yellow light for expanding the color reproduction range or sub pixels for emitting yellow light, and cyan light for expanding the color reproduction range.

The transistors of the driving circuit may be formed from n-channel thin film transistors (TFTs). As occasion demands, a p-channel field effect transistor may be used, for example, for the light emission control transistor. Further, a field effect transistor such as, for example, a MOS transistor formed on a silicon semiconductor substrate may be used. Meanwhile, the capacitor section may include two electrodes, and a dielectric layer or insulating layer sandwiched between the electrodes. The transistors and the capacitor section which form the driving circuit are formed in a certain supported plane. The light emitting section is formed above the transistors and the capacitor section of the driving circuit, for example, with an interlayer insulating layer interposed therebetween. The second one of the source/drain regions of the driving transistors is connected to the anode electrode provided in the light emitting section, for example, through a contact hole.

The organic EL display apparatus to which the driving method of the present embodiment is applied may include:

(a) a scanning circuit;

(b) an image signal outputting circuit;

(c) totaling N×M organic electroluminescence elements arrayed in a two-dimensional matrix, wherein N organic electroluminescence elements are arrayed in a first direction, and M organic electroluminescence elements are arrayed in a second direction different from the first direction;

(d) M scanning lines connected to the scanning circuit and extending in the first direction;

(e) N data lines connected to the image signal outputting circuit and extending in the second direction;

(f) M light emission control transistor control lines connected to the light emission controlling transistor control circuit and extending in the first direction; and (g) a power supplying section.

Each of the organic electroluminescence elements (hereinafter referred to simply as organic EL elements) includes a driving circuit including a driving transistor, an image signal writing transistor, a light emission control transistor and a capacitor section, and a organic electroluminescence light emitting section.

In the driving method, after the light emission control transistor is placed into a state wherein it maintains an on state thereof, a mobility correction process is executed simultaneously with a writing process wherein an image signal is applied from the data line to the first node. Here, since the light emission control transistor is maintained in an on state in advance, the time length of the writing process, that is, the time length of the mobility correction process, is defined only by the period of time within which the image signal writing transistor remains in an on state. Further, when the mobility correction/writing process is carried out before and after such mobility correction/writing process, since the potential at the third node is in a state wherein it is maintained substantially equal to the voltage of the current supplying section, even if the potential at the gate electrode of the driving transistor varies, the influence of such variation does not propagate to the gate electrode of the light emission control transistor through parasitic capacitance. Since the potential variation at the gate electrode of the light emission control transistor does not have any influence on the time length of the mobility correction process in this manner, problems such as the deterioration in the quality of the display screen image caused by a variation of the time length of the mobility correction process can be eliminated.

DETAILED DESCRIPTION OF THE PREFERRED EMBODIMENTS

In the following, the present invention is described in detail with reference to preferred embodiments thereof. However, prior to the description, an outline of an organic EL display apparatus used in the embodiments is described.

Figure 1:
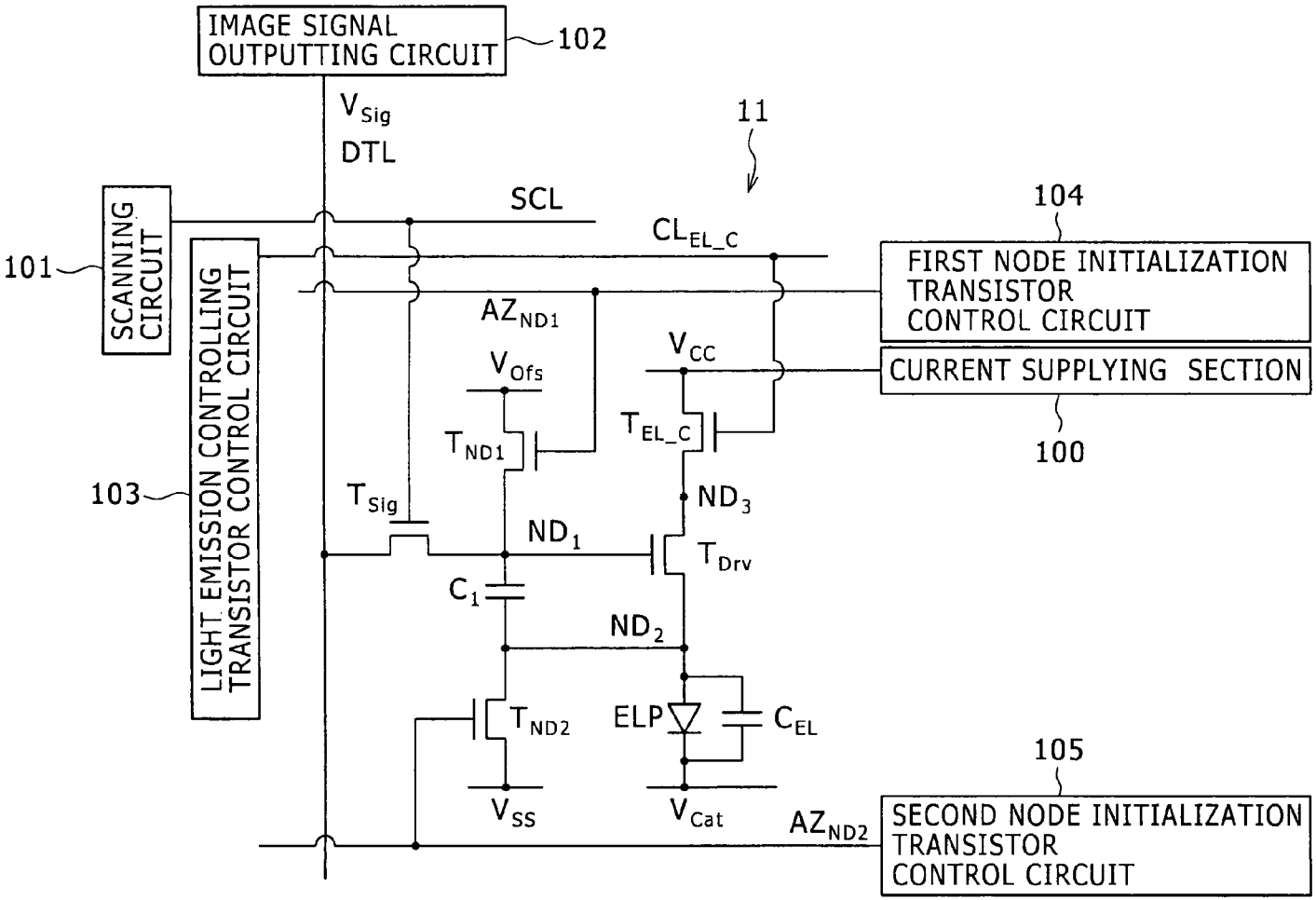
FIG. 1 is an equivalent circuit diagram of a driving circuit basically configured from 5 transistors and 1 capacitor section according to an embodiment 1 of the present invention.
Figure 2:
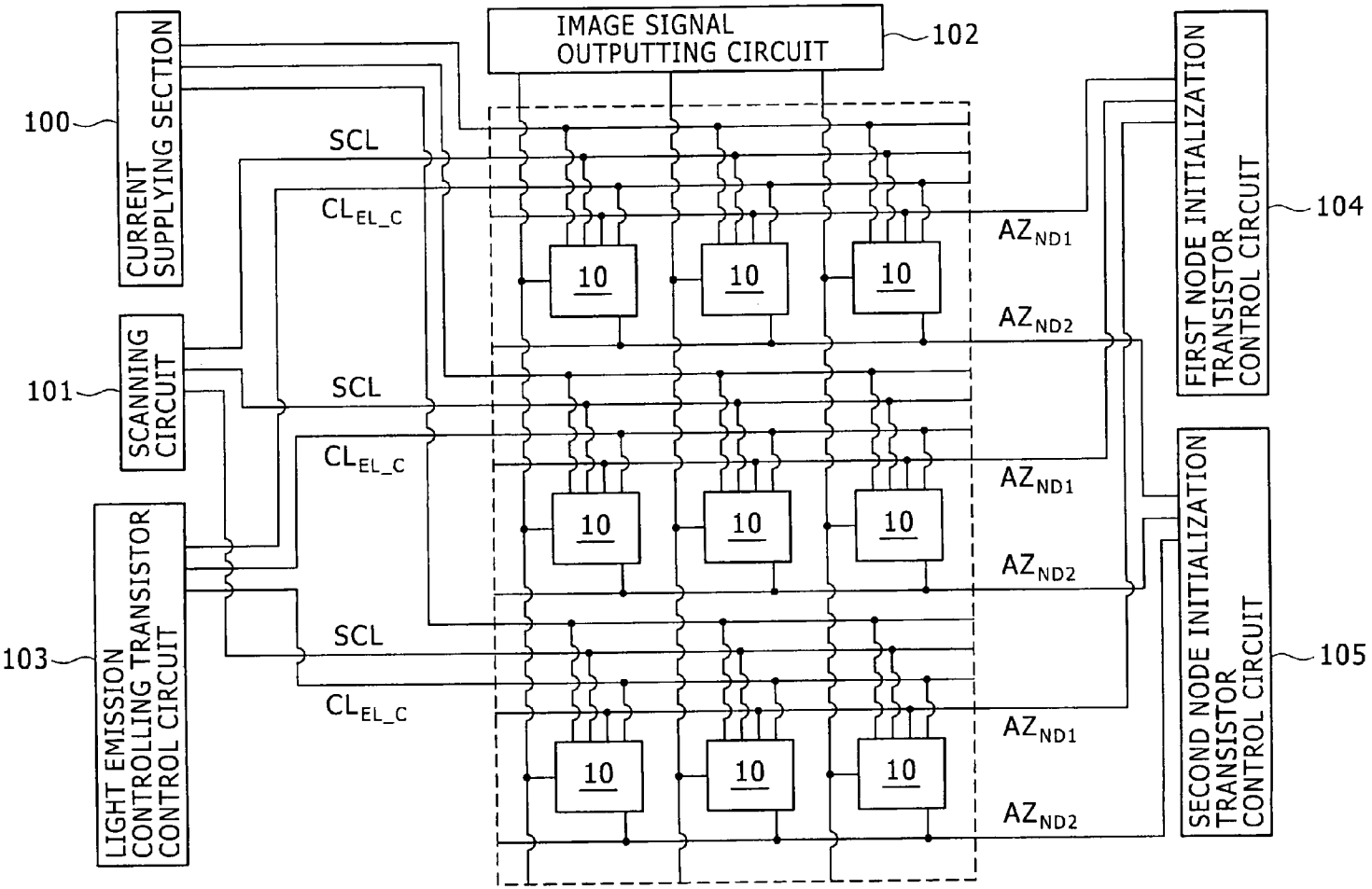
FIG. 2 is a block diagram of a display apparatus including the driving circuit shown in FIG. 1.
Figure 6:
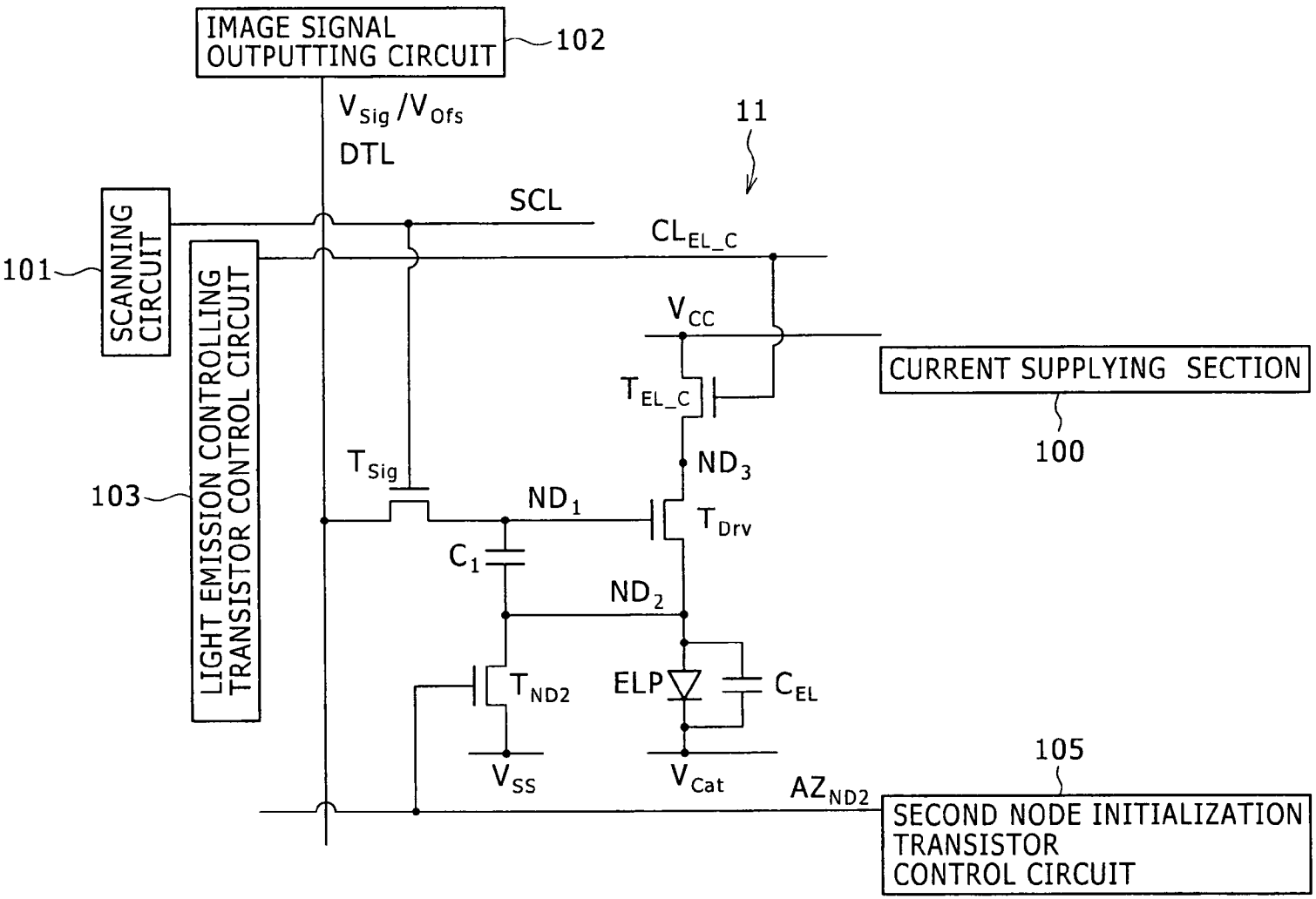
FIG. 6 is an equivalent circuit diagram of a driving circuit basically configured from 4 transistors and 1 capacitor section according to an embodiment 2 of the present invention.
Figure 7:
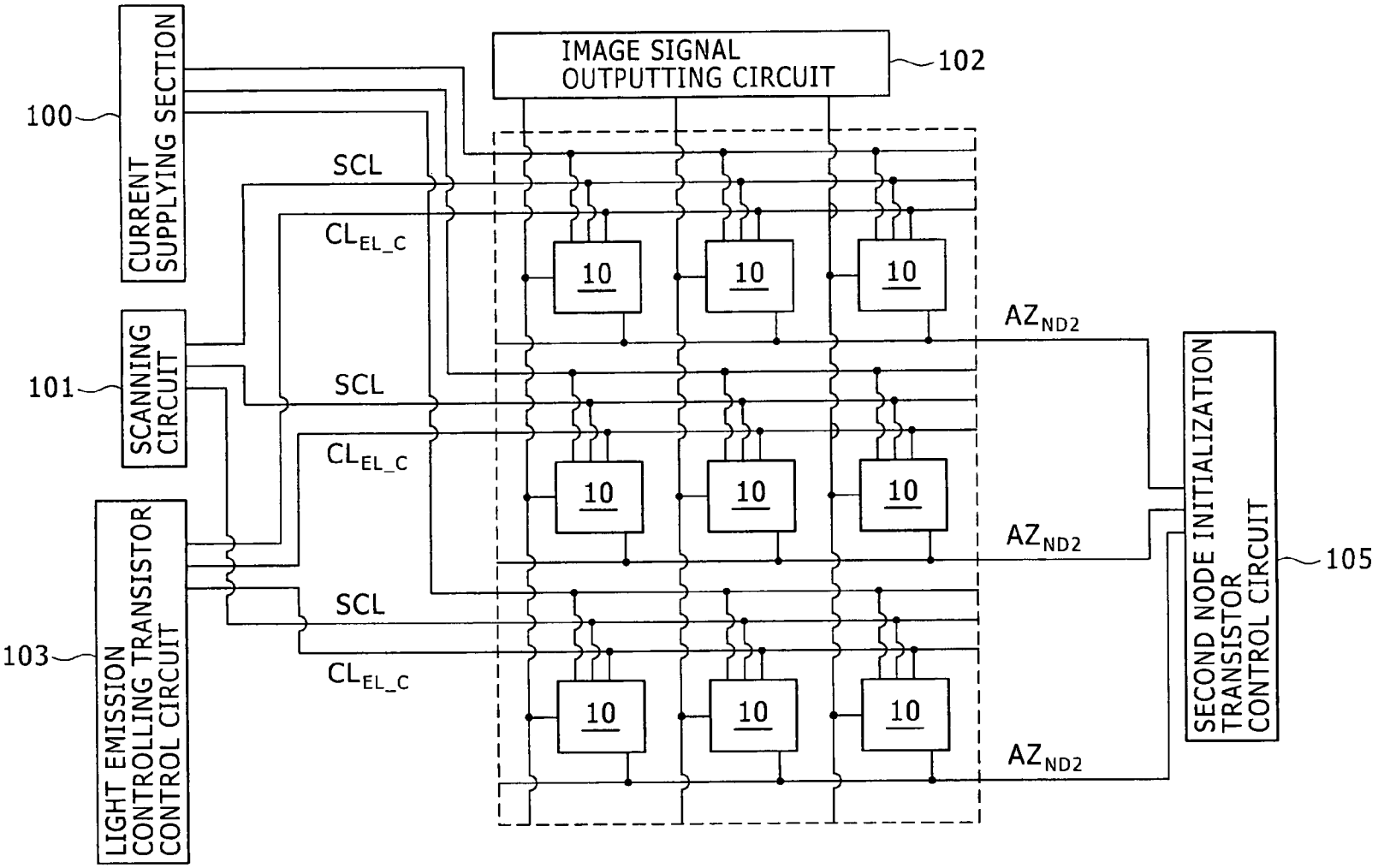
FIG. 7 is a block diagram of a display apparatus including the driving circuit shown in FIG. 6.
Figure 11:
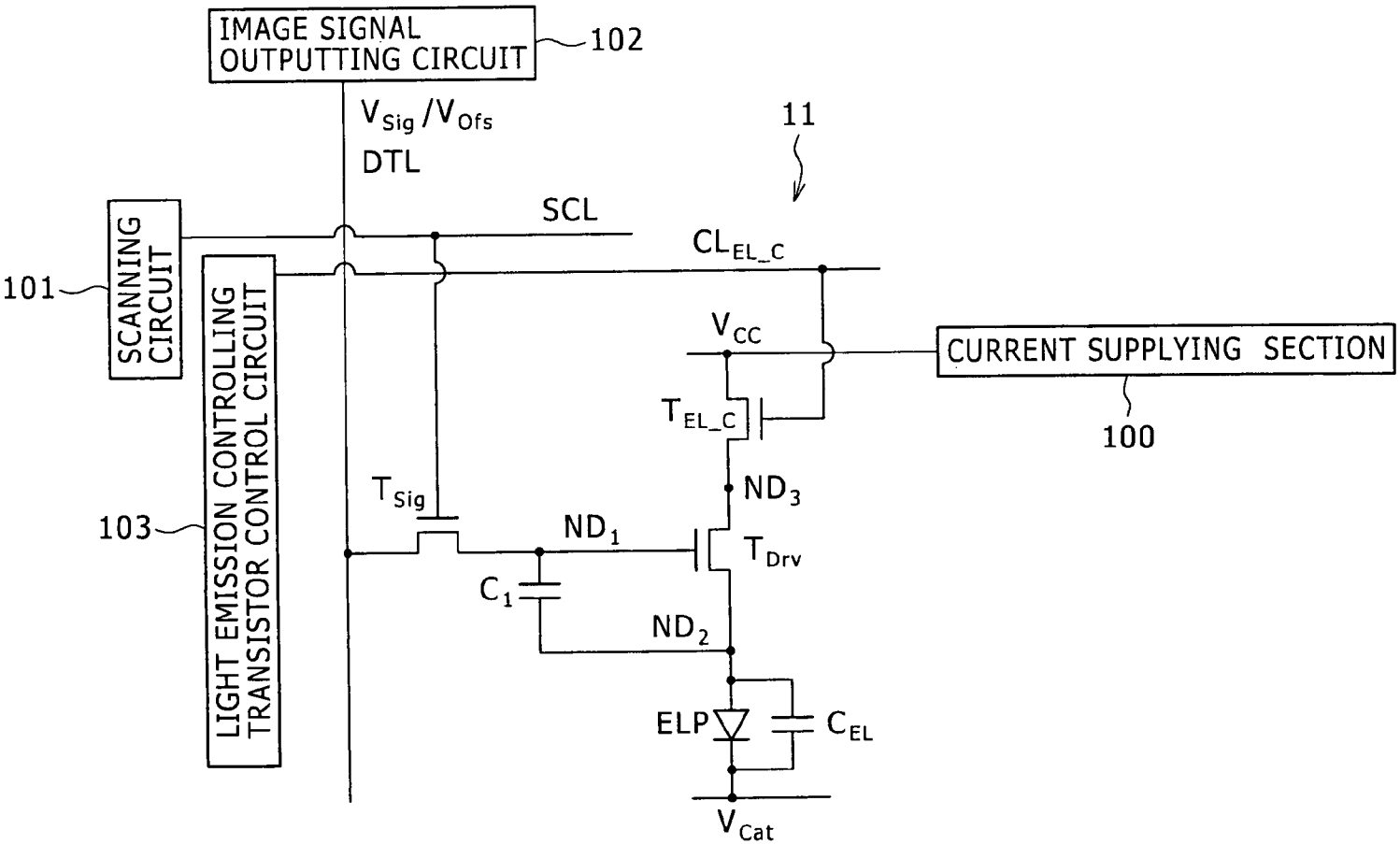
FIG. 11 is an equivalent circuit diagram of a driving circuit basically configured from 3 transistors and 1 capacitor section according to an embodiment 3 of the present invention.
Figure 12:
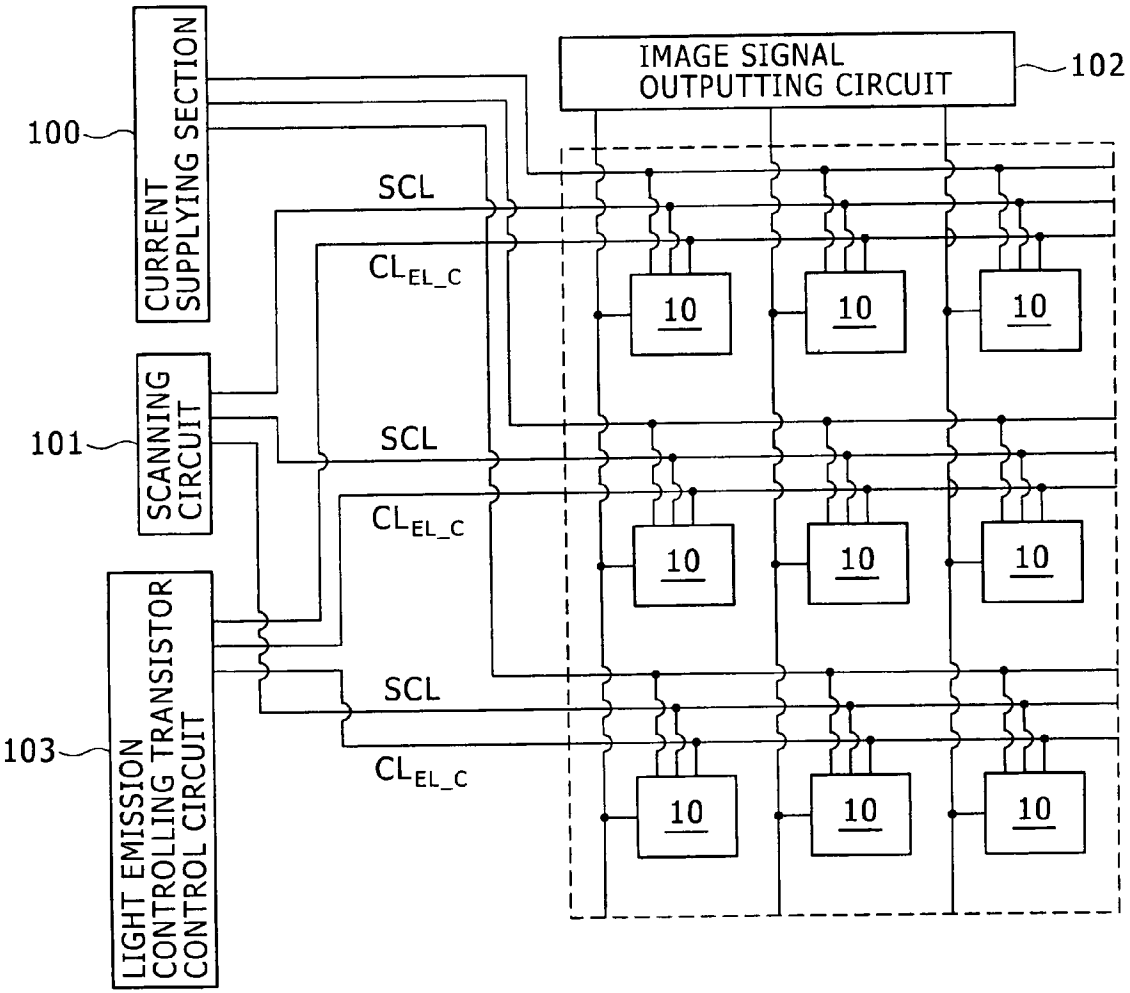
FIG. 12 is a block diagram of a display apparatus including the driving circuit shown in FIG. 11.

The organic EL display apparatus used in the embodiments includes a plurality of pixels. Each pixel is composed of a plurality of sub pixels, which include, in the embodiments described below, a red light emitting sub pixel, a green light emitting sub pixel and a blue light emitting sub pixel. Each of the sub pixels includes an organic electroluminescence element organic EL element 10, having a structure wherein a driving circuit 11 and an organic electroluminescence light emitting section, or light emitting section ELP connected to the driving circuit 11, are stacked. Equivalent circuit diagrams of organic EL display apparatus according to embodiments 1, 2 and 3 are shown in FIGS. 1, 6 and 11, respectively. Block diagrams of the organic EL display apparatus according to the embodiments 1, 2 and 3 are shown in FIGS. 2, 7 and 12, respectively. It is to be noted that FIGS. 1 and 2 show a driving circuit formed basically from 5 transistors and 1 capacitor section; FIGS. 6 and 7 show another driving circuit formed basically from 4 transistors and 1 capacitor section; and FIGS. 11 and 12 show a further driving circuit formed basically from 3 transistors and 1 capacitor section.

The organic EL display apparatus according to the embodiments include:

(a) a scanning circuit 101;

(b) an image signal outputting circuit 102;

(c) totaling N×M organic EL elements 10 arrayed in a two-dimensional matrix, wherein N organic EL elements 10 are arranged in a first direction, and M organic EL elements 10 are arranged in a second direction, which may be a perpendicular direction to the first direction;

(d) M scanning lines SCL connected to the scanning circuit 101 and extending in the first direction;

(e) N data lines DTL connected to the image signal outputting circuit 102 and extending in the second direction;

(f) M light emission control transistor control lines $CL_{EL_C}$ connected to a light emission controlling transistor control circuit 103, extending in the first direction; and (g) a current supplying section 100.

It is to be noted that, while, in FIGS. 2, 7 and 12, 3×3 organic EL elements 10 are shown, they are examples to the end.

The light emitting section ELP has a configuration and structure including, for example, an anode electrode, a hole transport layer, a light emitting layer, an electron transport layer, and a cathode electrode. Further, the scanning circuit 101 is provided at one end of the scanning lines SCL. The scanning circuit 101, image signal outputting circuit 102, scanning lines SCL, data lines DTL, and current supplying section 100 may individually have a known configuration and structure.

Where a driving circuit is formed from minimum components, it includes a driving transistor $T_{Drv}$, an image signal writing transistor $T_{Sig}$, a light emission control transistor $T_{EL_C}$, and a capacitor section $C_1$ having a pair of electrodes. The driving transistor $T_{Drv}$ is formed from an n-channel TFT having source/drain regions, a channel formation region, and a gate electrode. Also, the image signal writing transistor $T_{Sig}$ is formed from an n-channel TFT having source/drain regions, a channel formation region, and a gate electrode. Further, the light emission control transistor $T_{EL_C}$ is formed from an n-channel TFT having source/drain regions, a channel formation region, and a gate electrode. The light emission control transistor $T_{EL_C}$ and the image signal writing transistor $T_{Sig}$ may be formed from a p-channel TFT.

Here, the driving transistor $T_{Drv}$ is configured such that:

(A-1) The first end (hereinafter referred to as drain region) of the source/drain regions is connected to a second end of the source/drain regions of the light emission control transistor $T_{EL_C}$; that (A-2) The second end (hereinafter referred to as source region) of the source/drain regions is connected to an anode electrode provided in the light emitting section ELP, and is connected to the first end of the electrodes of the capacitor section $C_1$ to form a second node $ND_2$; and that (A-3) the gate electrode is connected to the second end of the source/drain regions of the image signal writing transistor $T_{Sig}$ and is connected to the second end of the electrodes of the capacitor section $C_1$ to form a first node $ND_1$.

It is to be noted that the drain region of the driving transistor $T_{Drv}$ and the other end of the source/drain regions of the light emission control transistor $T_{EL_C}$ OCCUPY, for example, the same region, and the region is hereinafter referred to as third node $ND_3$.

Further, the image signal writing transistor $T_{Sig}$ is configured such that:

(B-1) a first one of the source/drain regions is connected to a data line DTL; and that (B-2) the gate electrode is connected to a scanning line SCL.

Furthermore, the light emission control transistor is configured such that:

(C-1) a first one of the source/drain regions is connected to a current supplying section 100; and that (C-2) the gate electrode is connected to a light emission control transistor control line $CL_{EL_C}$.

Figure 16:
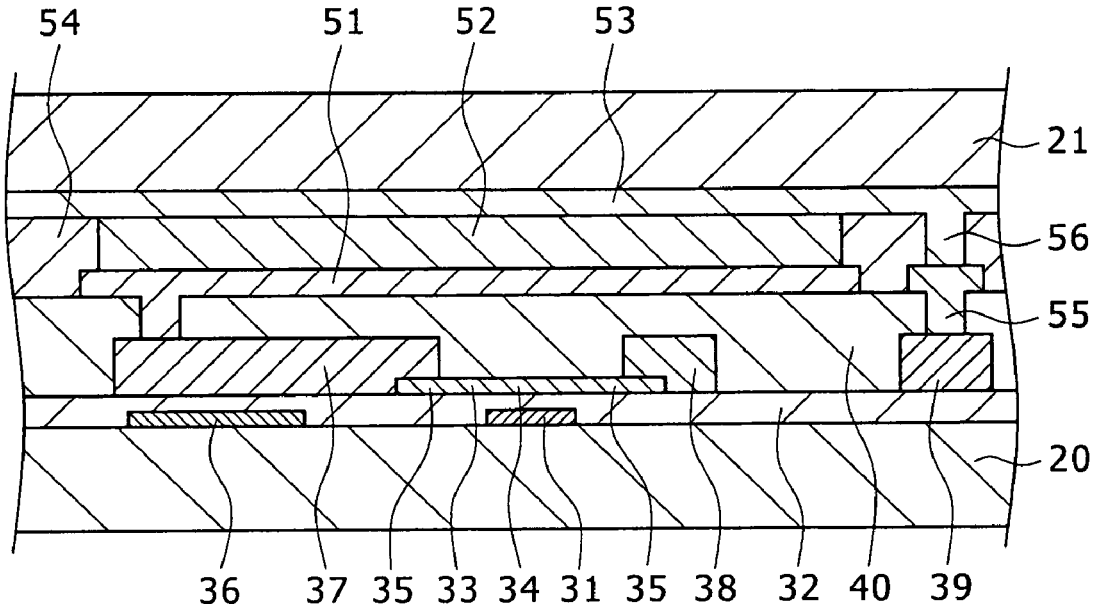
FIG. 16 is a partial sectional view schematically showing part of an organic electroluminescence element.
Figure 17:
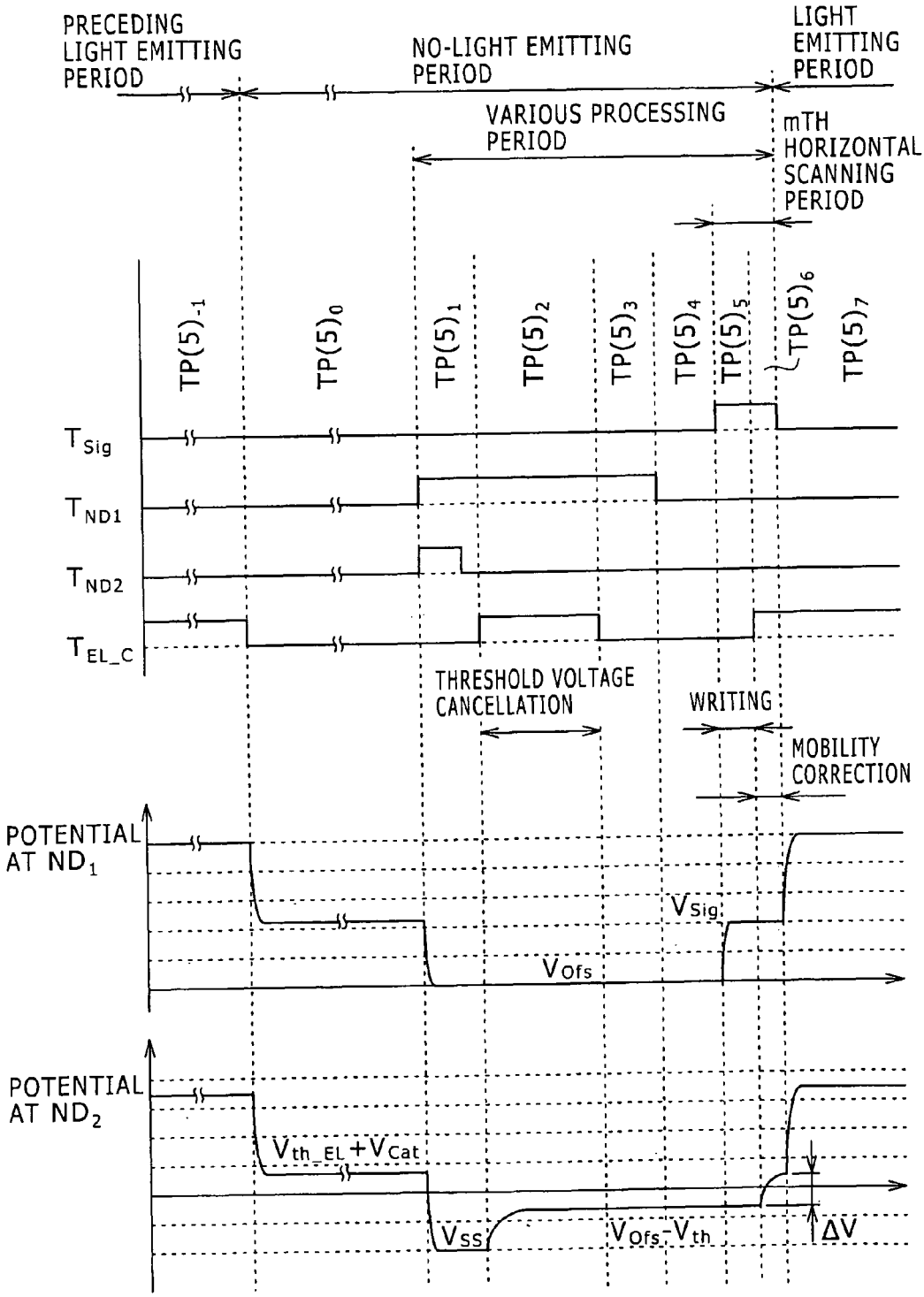
FIG. 17 is a timing chart illustrating operation of an existing driving circuit basically configured from 5 transistors and 1 capacitor section.

More particularly, as seen from FIG. 16 which shows a schematic cross section of part of an organic electroluminescence element, the transistors $T_{Sig}$ and $T_{Drv}$ and the capacitor section $C_1$, which form a driving circuit, are formed on a support. Meanwhile, the light emitting section ELP is formed above the transistors $T_{Sig}$ and $T_{Drv}$ and the capacitor sections $C_1$, which form the driving circuit, with an interlayer insulating layer 40 interposed therebetween. Meanwhile, the other of the source/drain regions of the driving transistor $T_{Drv}$ is connected to the anode electrode provided on the light emitting section ELP through a contact hole. It is to be noted that FIG. 16 only shows the driving transistor $T_{Drv}$. The image signal writing transistor $T_{Sig}$ and the other transistors are hidden by the driving transistor $T_{Drv}$ and cannot be seen.

More specifically, the driving transistor $T_{Drv}$ includes a gate electrode 31, a gate insulating layer 32, a semiconductor layer 33, source/drain regions 35 provided on the semiconductor layer 33, and a channel formation region 34 provided by a portion of a semiconductor layer 33 between the source/drain regions 35. Meanwhile, the capacitor section $C_1$ includes an electrode 36, a dielectric layer formed from an extension of the gate insulating layer 32, and another electrode 37 which corresponds to a second node $ND_2$. The gate electrode 31, part of the gate insulating layer 32 and the electrode 36 which forms the capacitor section $C_1$ are formed on a substrate 20. One of the source/drain regions 35 of the driving transistor $T_{Drv}$ is connected to a wiring line 38 while the other one of the source/drain regions 35 is connected to the electrode 37 which corresponds to the second node $ND_2$. The driving transistor $T_{Drv}$, capacitor section $C_1$ and so forth are covered with the interlayer insulating layer 40. A light emitting section ELP is provided on the interlayer insulating layer 40 and includes an anode electrode 51, a hole transport layer, a light emitting layer, an electron transport layer and a cathode electrode 53. It is to be noted that, in FIG. 16, the hole transport layer, light emitting Layer, and the electron transport layer are represented by one layer 52. On the portion of the interlayer insulating layer 40, which the light emitting section ELP is not provided, a second interlayer insulating layer 54 is provided, where a substrate 21 is disposed on the second interlayer insulating layer 54 and the cathode electrode 53 such that light emitted from the light emitting layer is emitted to the outside through the substrate 21. It is to be noted that the electrode 37, or second node $ND_2$, and the anode electrode 51 are connected to each other through a contact hole formed in the interlayer insulating layer 40. Further, the cathode electrode 53 is connected to a wiring line 39 provided on the extension of the gate insulating layer 32 through contact holes 55 and 56 formed in the second interlayer insulating layer 54 and the interlayer insulating layer 40, respectively.

The organic EL display apparatus includes N/3×M pixels arrayed in a two-dimensional matrix. The organic EL elements 10 which form the pixels, are driven line-sequentially, and the display frame rate is FR times/second. In particular, the organic EL elements 10 arrayed in the mth row, where m=1, 2, 3, . . . , M and forms the N sub pixels (pixels N/3), are driven at the same time. In other words, in the organic EL elements 10 which form one row, the light emission/no-light emission timings are controlled in a unit of a row to which the organic EL elements 10 belong. It is to be noted that a process, hereinafter referred to as simultaneous writing process, of writing an image signal into pixels that form one row, may be a process of writing an image signal at the same time into all pixels, or a process, hereinafter referred to merely as sequential writing process, of writing an image signal sequentially into the pixels. The writing processes to be applied may suitably be selected based on the configuration of the driving circuit.

Here, driving and operation relating to an organic EL element 10 which forms one sub pixel in a pixel positioned at the mth row and the nth column where n=1, 2, 3, . . . , N as a representative is described. Such a sub pixel or organic EL element 10 as just mentioned is hereinafter referred to as the (n, m)th sub pixel or the (n, m)th organic EL element 10. Various processes, including a threshold voltage cancellation process and a mobility correction/writing process, hereinafter described are carried out before the horizontal scanning period for the organic EL elements 10 arrayed in the mth row, that is, an mth horizontal scanning period, ends. It is to be noted that, although the mobility correction/writing process is carried out within the mth horizontal scanning period, as occasion demands, it may be carried out otherwise over the (m−m")th to mth horizontal scanning periods. On the other hand, depending upon the type of the driving circuit, the threshold voltage cancellation process and a preprocess for the threshold voltage cancellation process may be carried out preceding to the mth horizontal scanning period.

After all of the processes mentioned above end, the light emitting sections of the organic EL elements 10 arrayed in the mth row are driven to emit light. It is to be noted that the light emitting sections may emit light immediately after all of the processes described above end, or may emit light after a lapse of the predetermined period of time such as, for example, a horizontal scanning period for a predetermined number of rows elapses after all of the processes end. The predetermined period of time may be set suitably in accordance with the specifications of the organic EL display apparatus, the configuration of the driving circuit, etc. It is to be noted that in the following description, for the convenience of the description, it is assumed that the light emitting sections emit light immediately after the processes end. Then, the light emission of the light emitting section, which forms each of the organic EL elements 10 arrayed in the mth row continues until a point in time immediately before the horizontal scanning period for the organic EL elements 10 arrayed in the (m+m')th row starts. Here, "m'" is determined depending upon the design specifications of the organic EL display apparatus. In particular, the light emission of the light emitting section, which forms each of the organic EL elements 10 arrayed in the mth row of a certain display frame, continues until the (m+m'−1) th row. Meanwhile, the light emitting section, which forms each of the organic EL elements 10 arrayed in the mth row, keeps its no-light emitting state from a starting point of the (m+m')th horizontal scanning period to another point of time at which the mobility correction/writing process is completed within the mth horizontal period for a next display frame. In the period described above where no light is emitted, hereinafter referred to merely as no-light emitting period, fuzziness by an afterimage involved in active matrix driving is reduced, and consequently, the moving picture quality can be improved. However, the light emitting state/no-light emitting state of the sub pixels or organic EL elements 10 are not limited to the states described above. Further, the time length of a horizontal scanning period is less than 1/FR×1/M second. When the value of m+m' exceeds M, the excess of the horizontal scanning period is processed in a next display frame.

The term "one source/drain region" between two source/drain regions of one transistor is sometimes used to signify one of the source/drain regions is connected to a power supply section. Further, a transistor in an on state signifies a state wherein a channel is formed between the source/drain regions. In this instance, it does not matter whether or not the current flows from one source/drain region to the other source/drain region of the transistor. On the other hand, the transistor in an off state signifies a state wherein no channel is formed between the source/drain regions. Further, a source/drain region of a certain transistor connected to a source/drain region of another transistor signifies a form wherein the source/drain region of the certain transistor and the source/drain region of the other transistor occupy the same region. Furthermore, the source/drain regions can be formed not only from a conductive substance, such as polycrystalline silicon or amorphous silicon containing impurity, but also from metal, alloy, conductive particles, a stack structure including such metal, alloy or conductive particles, or a layer formed from an organic material or conductive polymer. Further, in timing charts used in the following description, the length of the axis of abscissa indicative of a period, that is, the time length, is schematic, but does not indicate the ratio in time length between different periods.

In the following description, driving methods for the light emitting section ELP, wherein a 5Tr/1C driving circuit, a 4Tr/1C driving circuit, and a 3Tr/1C driving circuit are used, are described in connection with the preferred embodiments of the present invention.

Embodiment 1

Embodiment 1 is directed to a driving method for an electroluminescence light emitting section according to the present embodiment. In embodiment 1, the driving circuit is formed as a 5Tr/1C driving circuit.

Figure 3:
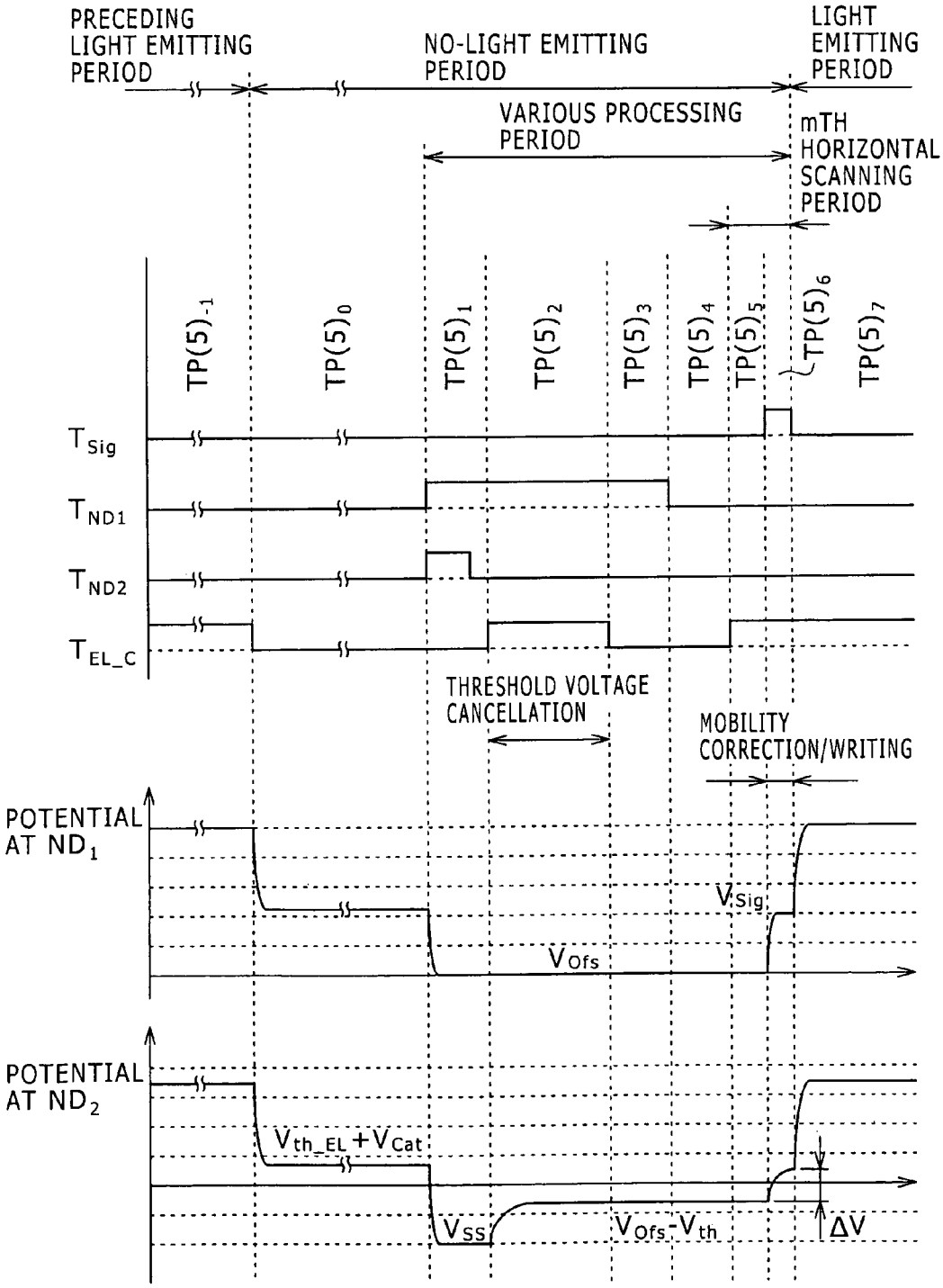
FIG. 3 is a timing chart illustrating driving of the driving circuit shown in FIG. 1.

An equivalent circuit diagram and a block diagram of the 5Tr/1C driving circuit are shown in FIGS. 1 and 2, respectively. A timing chart in driving of the 5Tr/1C driving circuit is shown in FIG. 3, and on/off states of transistors of the 5Tr/1C driving circuit are schematically illustrated in FIGS. 4A to 4D and 5A to 5E.

Referring to FIGS. 1 to 5E, the 5Tr/1C driving circuit includes five transistors, including an image signal writing transistor $T_{Sig}$, a driving transistor $T_{Drv}$, a light emission control transistor $T_{EL_C}$, a first node initialization transistor $T_{ND1}$, a second node initialization transistor $T_{ND2}$, and further includes one capacitor section $C_1$.

[Light Emission Control Transistor $T_{EL_C}$]

One source/drain region of the light emission control transistor $T_{EL_C}$ is connected to a current supplying section 100 for supplying a voltage $V_{CC}$, while the other source/drain of the light emission control transistor $T_{EL_C}$ is connected to one source/drain region of the driving transistor $T_{Drv}$. On/off operations of the light emission control transistor $T_{EL_C}$ are controlled by a light emission control transistor control line $CL_{EL_C}$ connected to the gate electrode of the light emission control transistor $T_{EL_C}$. It is to be noted that the current supplying section 100 is provided so as to supply current to the light emitting section ELP of the organic EL element 10 to control light emission of the light emitting section ELP. Further, the light emission control transistor control line $CL_{EL_C}$ is connected to the light emission controlling transistor control circuit 103.

[Driving Transistor $T_{Drv}$]

One source/drain region of the driving transistor $T_{Drv}$ is connected to the other source/drain region of the light emission control transistor $T_{EL_C}$ as described hereinabove. In particular, one source/drain region of the driving transistor $T_{Drv}$ is connected to the current supplying section 100 through the light emission control transistor $T_{EL_C}$. Meanwhile, the other source/drain region of the driving transistor $T_{Drv}$ is connected to

[1] the anode electrode of the light emitting section ELP,

[2] the other source/drain region of the second node initialization transistor $T_{ND2}$, and

[3] one of electrodes of the capacitor section $C_1$, and forms the second node $ND_2$. Meanwhile, the gate electrode of the driving transistor $T_{Drv}$ is connected to

[1] the other source/drain region of the image signal writing transistor $T_{Sig}$,

[2] the other source/drain region of the first node initialization transistor $T_{ND1}$, and

[3] the other electrode of the capacitor section $C_1$ and forms a first node $ND_1$.

When the organic EL element 10 is in a light emitting state, the driving transistor $T_{Drv}$ is driven so as to supply drain current $I_{ds}$ in accordance with the following expression (1):

$$I_{ds}=k\cdot\mu(V_{gs}-V_{th})^2 \quad (1)$$

where

μ: effective mobility

L: channel length

W: channel width $V_{gs}$: potential difference between the gate electrode and the other source/drain region which acts as a source region $V_{th}$: threshold voltage $C_{ox}$: (relative dielectric constant of the gate insulating layer)× (dielectric constant of vacuum)/(thickness of the gate insulating layer)

$$k\equiv(1/2)\cdot(W/L)\cdot C_{ox}$$

In the light emitting state of the organic EL element 10, one of the source/drain regions of the driving transistor $T_{Drv}$ acts as a drain region, while the other source/drain region acts as a source region. For the convenience of the following description, the one source/drain region of the driving transistor $T_{Drv}$ is sometimes referred to as a drain region and the other source/drain region is sometimes referred to as a source region.

When the drain current $I_{ds}$ flows through the light emitting section ELP of the organic EL element 10, the light emitting section ELP of the organic EL element 10 emits light. Further, the light emitting state, that is, the luminance of the emitted light, of the light emitting section ELP in the organic EL element 10 is controlled by the magnitude of the value of the drain current $I_{ds}$.

[Image Signal Writing Transistor $T_{Sig}$]

The other source/drain region of the image signal writing transistor $T_{Sig}$ is connected to the gate electrode of the driving transistor $T_{Drv}$ as described hereinabove. Meanwhile, the one source/drain region of the image signal writing transistor $T_{Sig}$ is connected to the data line DTL such that an image signal (driving signal or luminance signal) $V_{Sig}$ for controlling the luminance of the light emitting section ELP is supplied from the image signal outputting circuit 102 to the one source/drain region through the data line DTL. It is to be noted that various signals or voltages such as a signal for precharge driving and various reference voltages may be supplied to the one source/drain region through the data line DTL. The on/off operations of the image signal writing transistor $T_{Sig}$ are controlled by a scanning line SCL connected to the gate electrode of the image signal writing transistor $T_{Sig}$.

[First Node Initialization Transistor $T_{ND1}$]

The other source/drain region of the first node initialization transistor $T_{ND1}$ is connected to the gate electrode of the driving transistor $T_{Drv}$ as described hereinabove. Meanwhile, a voltage $V_{Ofs}$ for initializing the potential at the first node $ND_1$, that is, the potential at the gate electrode of the driving transistor $T_{Drv}$, is supplied to the one source/drain region of the first node initialization transistor $T_{ND1}$. On/off operations of the first node initialization transistor $T_{ND1}$ are controlled by a first node initialization transistor control line $AZ_{ND1}$ connected to the gate electrode of the first node initialization transistor $T_{ND1}$. The first node initialization transistor control line $AZ_{ND1}$ is connected to a first node initialization transistor control circuit 104.

[Second Node Initialization Transistor $T_{ND2}$]

The other source/drain region of the second node initialization transistor $T_{ND2}$ is connected to the source region of the driving transistor $T_{Drv}$. Meanwhile, a voltage $V_{SS}$ for initializing the potential at the second node $ND_2$, that is, the potential at the source region of the driving transistor $T_{Drv}$, is supplied to the one source/drain region of the second node initialization transistor $T_{ND2}$. Further, on/off operations of the second node initialization transistor $T_{ND2}$ are controlled by a second node initialization transistor control line $AZ_{ND2}$, connected to the gate electrode of the second node initialization transistor $T_{ND2}$. The second node initialization transistor control line $AZ_{ND2}$ is connected to a second node initialization transistor control circuit 105.

[Light Emitting Section ELP]

The anode electrode of the light emitting section ELP is connected to the source region of the driving transistor $T_{Drv}$ as described above. Meanwhile, a voltage $V_{Cat}$ is applied to the cathode electrode of the light emitting section ELP. The parasitic capacitance of the light emitting section ELP is represented by reference character $C_{EL}$. Further, the threshold voltage demanded for emission of light of the light emitting section ELP is represented by $V_{th\text{-}EL}$. In particular, the light emitting section ELP emits light if a voltage higher than the voltage $V_{th\text{-}EL}$ is applied between the anode electrode and the cathode electrode of the light emitting section ELP.

The applied voltages or potential values given below are values for explanation to the end, and are not restricted to the given values.

$V_{Sig}$: image signal for controlling the luminance of the light emitting section ELP
0 to 10 volts $V_{CC}$: voltage of the current supplying section for controlling the light emission of the light emitting section ELP
20 volts $V_{Ofs}$: voltage for initializing the potential at the gate electrode of the driving transistor $T_{Drv}$, i.e., potential at the first node $ND_1$
0 volt $V_{SS}$: voltage for initializing the potential at the source region of the driving transistor $T_{Drv}$, i.e., potential at the second node $ND_2$
−10 volts $V_{th}$: threshold voltage for the driving transistor $T_{Drv}$
3 volts $V_{Cat}$: voltage applied to the gate electrode of the light emitting section ELP
0 volt $V_{th\text{-}EL}$: threshold voltage of the light emitting section ELP
3 volts In the following, operation of the 5Tr/1C driving circuit is described. It is to be noted that, although it is assumed that a light emitting state begins immediately after all of various processes including a threshold voltage cancellation process and a mobility correction/writing process are completed as described above, operation of the 5Tr/1C driving circuit is not limited to this. This similarly applies also to description of the embodiments 2 and 3, that is, of the 4Tr/1C driving circuit and the 3Tr/1C driving circuit. [Period—TP(5)$_{-1}$] (refer to FIG. 4A)

This [period—TP(5)$_{-1}$] is a period within which the (n, m)th organic EL element 10 remains in a light emitting state after various processes in a preceding operation cycle are completed as operation in the preceding display frame. In particular, drain current $I'_{ds}$ based on an expression (4) hereinafter given flows through the light emitting section ELP of the organic EL element 10, which composes the (n, m)th sub pixel. The luminance of the organic EL element 10, which forms the n, m)th sub pixel, has a value corresponding to the drain current $I'_{ds}$. Here, the image signal writing transistor $T_{Sig}$, the first node initialization transistor $T_{ND1}$, and the second node initialization transistor $T_{ND2}$ are in an off state, placing the light emitting control transistor $T_{EL_C}$ and the driving transistor $T_{Drv}$ are in an on state. The light emitting state of the (n, m)th organic EL element 10 continues until a point of time at which a horizontal scanning period for the organic EL elements 10 arrayed in the (m+m')th row starts. It is to be noted that another configuration may be applied wherein the periods of [period—TP(5)$_1$] to [period—TP(5)$_4$] are included in the mth horizontal scanning period in the currently displayed frame.

Within the periods of [period—TP(5)$_0$] to [period—TP(5)$_4$] illustrated in FIG. 3, operation is carried out until the time immediately before the next mobility correction/writing process is carried out and after the light emitting state that follows the completion of various processes in a preceding operation cycle ends. In particular, the periods of [period—TP(5)$_0$] to [period—TP(5)$_4$] have a time length, for example, beginning with a starting timing of the (m+m')th horizontal scanning period in a preceding display frame to an ending timing of the (m−1)th horizontal scanning period in a current display frame. It is to be noted that periods between [period—TP(5)$_1$] to [period—TP(5)$_4$] may otherwise be included in the mth horizontal scanning period in the current display frame.

Then, within the periods of [period—TP(5)$_0$] to [period—TP(5)$_4$], the (n, m)th organic EL element 10 is in a no-light emitting state. In particular, within the periods of [period—TP(5)$_0$] to [period—TP(5)$_1$] and [period—TP(5)$_3$] to [period—TP(5)$_4$], the organic EL elements 10 does not emit light because the light emission control transistor $T_{EL_C}$ is in an off state. It is to be noted that, within the [period—TP(5)$_2$], the light emission control transistor $T_{EL_C}$ exhibits an on state. However, within this period, the threshold voltage cancellation process hereinafter described is being carried out. Although detailed description is given in the description of the threshold voltage cancellation process, if it is assumed that an expression (2) hereinafter given is satisfied, then the organic EL element 10 does not emit light.

In the following, the periods of [period—TP(5)$_0$] to [period—TP(5)$_4$] are described first. It is to be noted that the starting time of the [period—TP(5)$_1$] and the periods of [period—TP(5)$_1$] to [period—TP(5)$_4$] may be set suitably in accordance with the design of the organic EL display apparatus.

[Period—TP(5)$_0$]

As described hereinabove, within the [period—TP(5)o], the (n, m)th organic EL element 10 is in a no-light emitting state. The image signal writing transistor $T_{Sig}$, first node initialization transistor $T_{ND1}$, and second node initialization transistor $T_{ND2}$ are in an off state. Meanwhile, at a point in time of transition from the [period—TP(5)$_{-1}$] to the [period—TP(5)$_0$], the light emission control transistor $T_{EL_C}$ is placed into an off state. Therefore, the potential at the second node $ND_2$, that is, the source region of the driving transistor $T_{Drv}$ or the anode electrode of the light emitting section ELP, drops to $V_{th\text{-}EL}+V_{Cat}$, and the light emitting section ELP is placed into a no-light emitting state. Further, the potential at the first node $ND_1$ also in a floating state, that is, at the gate electrode of the driving transistor $T_{Drv}$, drops in such a manner to follow the drop of the potential at the second node $ND_2$.

Figure 4A:
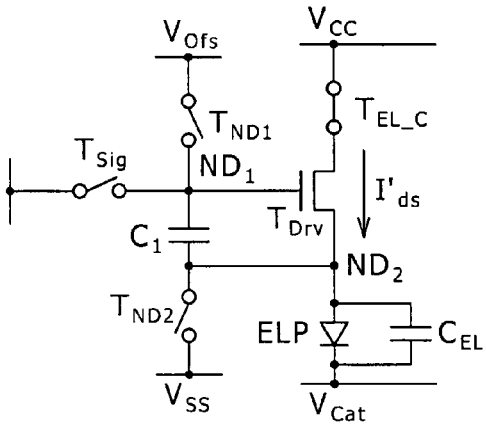
FIGS. 4A to 5E are circuit diagrams illustrating on/off states and of transistors which form the driving circuit shown in FIG. 1.
Figure 4B:
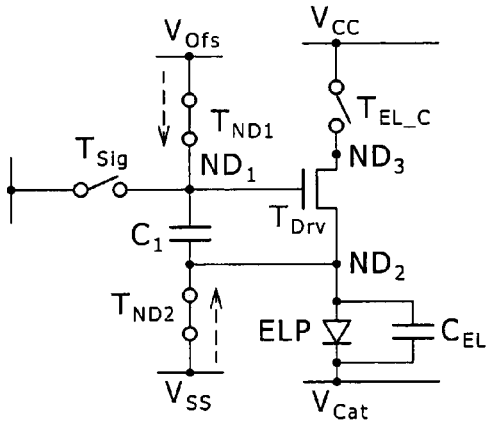
Figure 4C:
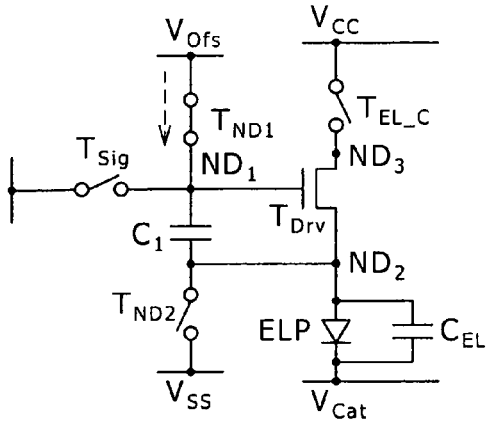

[Period—TP(5)$_1$] (refer to FIGS. 4B and 4C)

Within this [period—TP(5)$_1$], a preprocess for subsequently carrying out the threshold voltage cancellation process hereinafter described is carried out. In particular, a first node initialization voltage is applied to the first node $ND_1$ and a second node initialization voltage is applied to the second node $ND_2$. The potential difference between the first node $ND_1$ and the second node $ND_2$ may then exceed the threshold voltage $V_{th}$ of the driving transistor $T_{Drv}$, and besides the potential difference between the cathode electrode of the light emitting section ELP and the second node $ND_2$, may not exceed the threshold voltage $V_{th\text{-}EL}$ of the light emitting section ELP. Furthermore, upon starting of the [period—TP(5)$_1$], the first node initialization transistor control circuit 104 and the second node initialization transistor control circuit 105 operate to set the first node initialization transistor control line $AZ_{ND1}$ and the second node initialization transistor control line $AZ_{ND2}$ to a high level, placing the first and second node initialization transistor $T_{ND1}$ and $T_{ND2}$, respectively, into an on state. As a result, the potential at the first node $ND_1$ becomes the voltage $V_{Ofs}$, for example, 0 volt. Meanwhile, the potential at the second node $ND_2$ changes to the voltage $V_{SS}$, for example, 10 volts. Then, prior to completion of the [period—TP(5)$_1$], the second node initialization transistor control circuit 105 operates to set the second node initialization transistor control line $AZ_{ND2}$ to a low level to place the second node initialization transistor $T_{ND2}$ into an off state. It is to be noted that the first node initialization transistor $T_{ND1}$ and the second node initialization transistor $T_{ND2}$ may be placed into an on state simultaneously, or the first node initialization transistor $T_{ND1}$ may be placed into an on state first, or conversely the second node initialization transistor $T_{ND2}$ may be placed into an on state first.

Through the processes described above, the potential difference between the gate region and the source region of the driving transistor $T_{Drv}$ becomes greater than the threshold voltage $V_{th}$, and the driving transistor $T_{Drv}$ is placed into an on state.

Figure 4D:
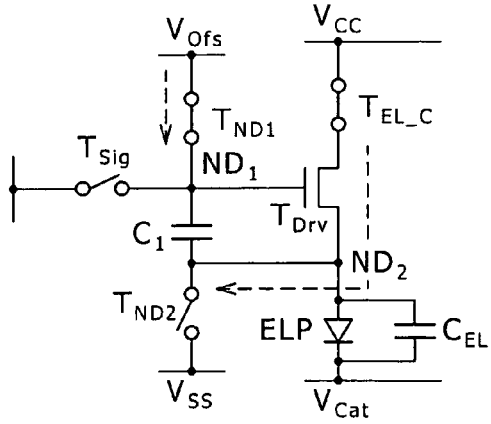

[Period—TP(5)$_s$] (refer to FIG. 4D)

Then, while the potential at the first node $ND_1$ is maintained, a voltage higher than the potential is applied that is the sum of the potential at the second node $ND_2$ and the threshold voltage $V_{th}$ of the driving transistor $T_{Drv}$ within the [period—TP(5)$_1$]. The voltage higher than the potential is applied from the current supplying section 100 to the first source/drain region, that is, the drain region, of the driving transistor $T_{Drv}$. A threshold voltage cancellation process is carried out to vary the potential difference between the first node $ND_1$ and the second node $ND_2$ toward the threshold voltage $V_{th}$ of the driving transistor $T_{Drv}$, particularly raising the potential at the second node $ND_2$. Furthermore, while the on state of the first node initialization transistor $T_{ND1}$ is maintained, the light emission controlling transistor control circuit 103 operates to set the light emission control transistor control line $CL_{EL_C}$ to the high level, placing the light emission control transistor $T_{EL_C}$ into an on state. As a result, although the potential at the first node $ND_1$ does not vary, that is, the voltage $V_{Ofs}$=0 volt is maintained, the potential at the second node $ND_2$ varies from the potential at the first node $ND_1$ toward the potential of the difference of the threshold voltage $V_{th}$ of the driving transistor $T_{Drv}$. Specifically, the potential at the second node $ND_2$ in a floating state rises. Then, if the potential difference between the gate electrode and the source region of the driving transistor $T_{Drv}$ reaches the threshold voltage $V_{th}$, then the driving transistor $T_{Drv}$ is placed into an off state. Furthermore, the potential at the second node $ND_2$ in a floating state approaches $V_{Ofs}-V_{th}=-3$ volts$>V_{SS}$, and finally becomes equal to $V_{Ofs}-V_{th}$. Here, if the expression (2) given below is assured, that is, the potentials are selected and determined so as to satisfy the expression (2), then the light emitting section ELP does not emit light. It is to be noted that qualitatively the degree at which the potential difference between the first node $ND_1$ and the second anode $ND_2$ (the potential difference between the gate electrode and the source region of the driving transistor $T_{Drv}$ in the threshold voltage cancellation process) approaches the threshold voltage $V_{th}$ of the driving transistor $T_{Drv}$ depends upon the time of the threshold voltage cancellation process. Accordingly, for example, if the time for the threshold voltage cancellation process is assured sufficiently long, the potential difference between the first node $ND_1$ and the second node $ND_2$ reaches the threshold voltage $V_{th}$ of the driving transistor $T_{Drv}$, thus placing the driving transistor $T_{Drv}$ into an off state. On the other hand, for example, if the time for the threshold voltage cancellation process is set short, then the potential difference between the first node $ND_1$ and the second node $ND_2$ sometimes becomes greater than the threshold voltage $V_{th}$ of the driving transistor $T_{Drv}$, and consequently, not placing the driving transistor $T_{Drv}$ into an off state. In other words, as a result of the threshold value cancellation process, the driving transistor $T_{Drv}$ need not necessarily be placed into an off state.

$$(V_{Ofs}-V_{th})<(V_{th\text{-}EL}+V_{cat}) \quad (2)$$

Within this [period—TP(5)$_2$], the potential at the second node $ND_2$ finally becomes $V_{Ofs}-V_{th}$. In other words, the potential at the second node $ND_2$ depends only upon the threshold voltage $V_{th}$ of the driving transistor $T_{Drv}$ and the voltage $V_{Ofs}$ for initializing the gate electrode of the driving transistor $T_{Drv}$. Or in other words, the potential at the second node $ND_2$ does not depend upon the threshold voltage $V_{th\text{-}EL}$.

Figure 5A:
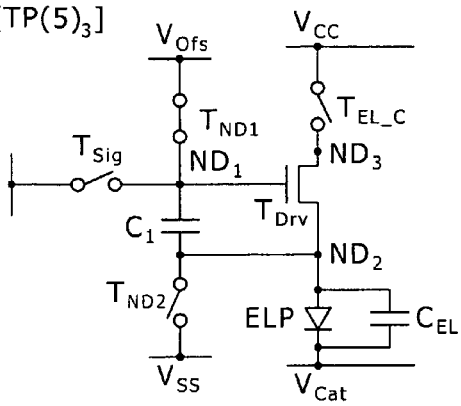

[Period—TP(5)$_3$] (refer to FIG. 5A)

Thereafter, while the on state of the first node initialization transistor $T_{ND1}$ is maintained, the light emission controlling transistor control circuit 103 operates to place the light emission control transistor control line $CL_{EL_C}$ into the low level to place the light emission control transistor $T_{EL_C}$ into an off state. As a result, the potential at the first node $ND_1$ does not vary, that is, the potential maintains $V_{Ofs}=0$ volt, and the potential at the second node $ND_2$ in a floating state also does not vary, but maintains $V_{Ofs}-V_{th}=-3$ volts.

Figure 5B:
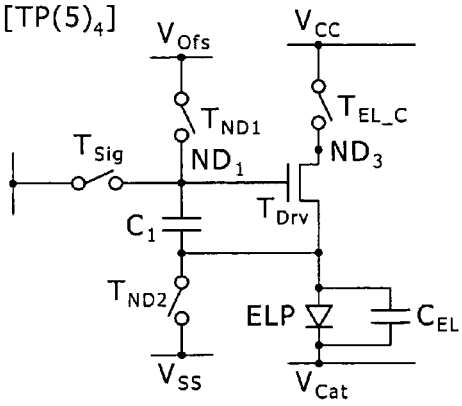
Figure 5C:
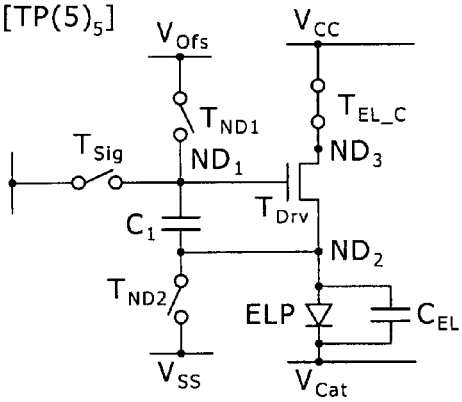

[Period—TP(5)$_4$] (refer to FIG. 5B)

The first node initialization transistor control circuit 104 then operates to set the first node initialization transistor control line $AZ_{ND1}$ to the low level to place the first node initialization transistor $T_{ND1}$ into an off state. The potentials at the first node $ND_1$ and the second node $ND_2$ do not vary substantially. Although a potential variation is actually caused by electrostatic coupling of parasitic capacitance or the like, normally it is possible to ignore the variation.

Now, operation within the periods of [period—TP(5)$_5$] to [period—TP(5)$_7$] is described. It is to be noted that, as hereinafter described, a preprocess for the mobility correction/writing process is carried out within the [period—TP(5)$_5$] and within the [period—TP(5)$_6$], the mobility correction/writing process is carried out simultaneously. Although it is necessary for the processes mentioned to be executed within the mth horizontal scanning period as described hereinabove, as occasion demands, the processes may be carried out over a plurality of scanning periods. This is similarly applied to the embodiments 2 and 3. However, in the embodiment 1, it is assumed that a starting timing of the [period—TP(5)$_5$] and an ending timing of the [period—TP(5)$_6$] coincide with the starting timing and ending timing of the mth horizontal scanning period, respectively, for the convenience of description.

Generally, where the driving transistor $T_{Drv}$ is formed from a polycrystalline silicon thin film transistor or the like, the dispersion that occurs among transistors cannot be avoided. Accordingly, even if the image signal $V_{Sig}$ of an equal value is applied to the gate electrode of a plurality of driving transistors $T_{Drv}$, among which the mobility μ is different, the difference appears between the drain current $I_{ds}$ flowing through a driving transistor $T_{Drv}$ having a high mobility μ while another driving transistor $T_{Drv}$ has a low mobility μ. Then, if such a difference as just mentioned appears, then the uniformity of the screen of the organic EL [Period—TP(5)$_5$] (refer to FIG. 5C)

Accordingly, a mobility correction/writing process including correction, that is, a mobility correction process, of the potential in the source region of the driving transistor $T_{Drv}$ or the second node $ND_2$ based on the magnitude of the mobility μ of the driving transistor $T_{Drv}$, is carried out. However, the succeeding preprocess is carried out prior to the mobility correction/writing process. In particular, the light emission control transistor $T_{EL_C}$ is placed into a state wherein it maintains an on state based on a signal from the light emission control transistor control line $CL_{EL_C}$. Furthermore, the light emission controlling transistor control circuit 103 operates to set the light emission control transistor control line $CL_{EL_C}$ to the high level, placing the light emission control transistor $T_{EL_C}$ into an on state. As a result, the potential at the first node $ND_1$ does not vary but maintains the voltage $V_{Ofs}=0$ volt, and the potential at the second node $ND_2$ in a floating state also does not vary, but maintains $V_{Ofs}-V_{th}=-3$ volts. In this state, the potential at the third node $ND_3$ generally becomes the voltage $V_{CC}$.

Figure 5D:
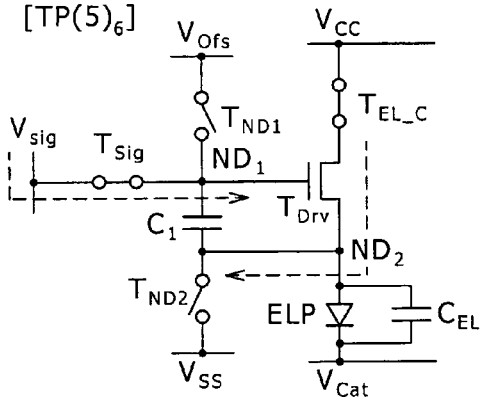

[Period—TP(5)$_6$] (refer to FIG. 5D)

Then, the correction of the potential, that is, a mobility correction process of the source region of the driving transistor $T_{Drv}$ (the second node $ND_2$) is carried out based on the magnitude of the mobility μ of the driving transistor $T_{Drv}$, and the writing process is simultaneously executed into the driving transistor $T_{Drv}$ In particular, while the first node initialization transistor $T_{ND1}$ and the second node initialization transistor $T_{ND2}$ maintain an off state, the image signal outputting circuit 102 operates to set the potential for the data line DTL to an image signal (driving signal or luminance signal) $V_{Sig}$ for controlling the luminance of the light emitting section ELP. Then, the scanning circuit 101 operates to set the scanning line SCL to the high level to place the image signal writing transistor $T_{Sig}$ into an on state. As a result, the potential at the first node $ND_1$ rises to the image signal voltage $V_{Sig}$. Then, after a predetermined time period to elapses, the scanning circuit 101 operates to set the scanning line SCL to the low level, placing the image signal writing transistor $T_{Sig}$ into an off state and the first node $ND_1$, that is, the gate electrode of the driving transistor $T_{Drv}$, into a floating state. As a result, where the value of the mobility U of the driving transistor $T_{Drv}$ is high, the increasing amount ΔV of the potential in the source region of the driving transistor $T_{Drv}$, that is, a potential correction value, is great. However, where the value of the mobility μ of the driving transistor $T_{Drv}$ is low, the increasing amount ΔV of the potential in the source region of the driving transistor $T_{Drv}$, that is, the potential correction value, is small. Here, the potential difference $V_{gs}$ between the gate voltage and the source region of the driving transistor $T_{Drv}$ is given by the following expression (3):

$$V_g = V_{Sig}$$

$$V_S \approx V_{Ofs} - V_{th} + \Delta V$$

$$V_{gs} \approx V_{Sig} - (V_{Ofs} - V_{th} + \Delta V) \quad (3)$$

In particular, the potential difference $V_{gs}$ obtained in the mobility correction/writing process for the driving transistor $T_{Drv}$ relies only upon the image signal (driving signal, luminance signal) $V_{gs}$ for controlling the luminance of the light emitting section ELP, the threshold voltage $V_{th}$ of the driving transistor $T_{Drv}$, and the increasing amount ΔV or potential correction value of the potential. The potential correction value relies upon the voltage $V_{Ofs}$ for initializing the gate electrode of the driving transistor $T_{Drv}$ and the mobility μ of the driving transistor $T_{Drv}$. Then, the potential difference $V_{gs}$ is independent of the threshold voltage $V_{th\text{-}EL}$ of the light emitting section ELP.

It is to be noted that the total time to of the [period—TP(5)$_6$], within which the mobility correction/writing process is carried out, may be determined in advance as a design value upon designing of the organic EL display apparatus. Further, the total time to of the [period—TP(5)$_6$] is determined so that the potential $V_{Ofs} - V_{th} + \Delta V$ in the source region of the driving transistor $T_{Drv}$ at this time satisfies the following expression (2'). Then, correction of the dispersion of the coefficient k ($\equiv(1/2)\cdot(W/L)\cdot C_{ox}$) is also carried out simultaneously by the mobility correction/writing process.

$$V_{Ofs} - V_{th} + \Delta V < V_{th\text{-}EL} + V_{Cat} \quad (2')$$

Figure 5E:
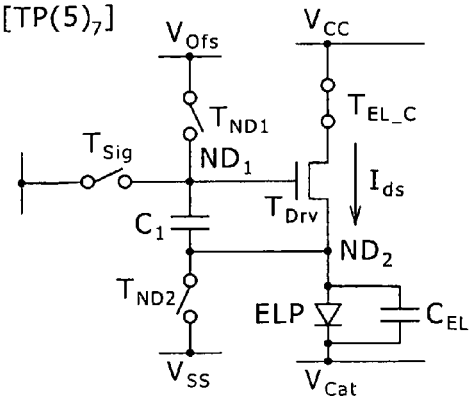

[Period—TP(5)$_7$] (refer to FIG. 5E)

Since the threshold voltage cancellation process and the mobility correction/writing process are completed by the operations described above, the image signal writing transistor $T_{Sig}$ is placed into an off state in accordance with a signal from the scanning line SCL. This places the first node $ND_1$ into a floating state, thereby supplying current corresponding to the value of the potential difference between the first node $ND_1$ and the second node $ND_2$ from the current supplying section 100 to the light emitting section ELP through the driving transistor $T_{Drv}$, which drives the light emitting section ELP. In particular, after the predetermined time to elapses, the scanning circuit 101 operates to set the scanning line SCL to the low level to place the image signal writing transistor $T_{Sig}$ into an off state, thereby placing the first node $ND_1$, that is, the gate electrode of the driving transistor $T_{Drv}$, into a floating state. Meanwhile, the light emission control $T_{EL_C}$ maintains the on state, and the drain region of the light emission control transistor $T_{EL_C}$ remains in a state wherein it is connected to the current supplying section 100 of the voltage $V_{CC}$, for example, of 20 volts for controlling the emission of light of the light emitting section ELP. As a result, the potential at the second node $ND_2$ rises. Here, since the gate electrode of the driving transistor $T_{Drv}$ is in a floating state as described above, besides the fact that the capacitor section $C_1$ exists, a phenomenon similar to that of a bootstrap circuit occurs with the gate electrode of the driving transistor $T_{Drv}$. Consequently, the potential at the first node $ND_1$ also rises. As a result, the potential difference $V_{gs}$ between the gate electrode and the source region of the driving transistor $T_{Drv}$ maintains the value of the expression (3). Further, since the potential at the second node $ND_2$ rises and exceeds $V_{th\text{-}EL} + V_{Cat}$, the light emitting section ELP begins to emit light. At this time, since the current flowing through the light emitting section ELP is drain current $I_{ds}$, which flows from the drain region to the source region of the driving transistor $T_{Drv}$, it can be represented by the expression (1). Here, from the expressions (1) and (3), the expression (1) can be transformed into the following expression (4):

$$I_{ds} = k\cdot\mu\cdot(V_{Sig} - V_{Ofs} - \Delta V)^2 \quad (4)$$

Accordingly, where the voltage $V_{Ofs}$ is set to 0 volt, the drain current $I_{ds}$ flowing through the light emitting section ELP increases in proportion to the square of the difference values of the voltage correction value ΔV for the second node $ND_2$. That is, for the source of the driving transistor $T_{Drv}$, a rising from the mobility μ of the driving transistor $T_{Drv}$ from the value of the image signal $V_{Sig}$ controls the luminance of the light emitting section ELP. In other words, the drain current $I_{ds}$ flowing through the light emitting section ELP, the emitted light amount (the luminance of the light emitting section ELP), depends neither on the threshold voltage $V_{th\text{-}EL}$ of the light emitting section ELP nor on the threshold voltage $V_{th}$ of the driving transistor $T_{Drv}$. Thus, the luminance of the (n, m)th organic EL element 10 has a value corresponding to the drain current $I_{ds}$.

Since the potential correction value ΔV increases as the mobility μ of the driving transistor $T_{Drv}$ increases, the value of the left side of the expression (4) decreases. Accordingly, even if the value of the mobility μ is high in the expression (4), the drain current $I_{ds}$ can be corrected because the value of $(V_{Sig} - V_{Ofs} - \Delta V)^2$ decreases. In other words, even if the driving transistor $T_{Drv}$ has a different mobility μ, as long as the value of the image signal $V_{Sig}$ is equal, the drain current $I_{ds}$ becomes substantially equal, and consequently, the drain current $I_{ds}$ flowing through the light emitting section ELP to control the luminance of the light emitting section ELP becomes uniform. In other words, the dispersion of the luminance of the light emitting section arising from the dispersion of the mobility μ and hence the dispersion of the coefficient k can be corrected.

The light emitting state of the light emitting section ELP continues until the (m+m'−1)th horizontal scanning period. This point of time corresponds to the end of the [period—TP(5)$_{-1}$].

The light emission operation of the organic EL element 10, that is, the (n, m)th sub pixel (organic EL element 10) is completed therewith.

With the driving method of the embodiment 1, the mobility correction process is carried out simultaneously in the writing process, wherein the image signal $V_{Sig}$ is applied from the data line DTL to the first node $ND_1$ in a state wherein the light emission control transistor $T_{EL_C}$ remains in an on state. Accordingly, the time length of the mobility correction/writing process is defined only by the time within which the image signal writing transistor $T_{Sig}$ remains in an on state. Further, before and after the mobility correction/writing process is carried out, since the potential at the third node $ND_3$ is in a state wherein it is kept substantially at the voltage $V_{CC}$ of the current supplying section, even if the potential at the gate electrode of the driving transistor $T_{Drv}$ changes to the image signal $V_{Sig}$, the influence of the change does not propagate to the gate electrode of the light emission control transistor $T_{EL_C}$ through the parasitic capacitance. Therefore, problems such as deterioration of the quality of the display screen image arising from the variation of the time length of the mobility correction process does not occur.

Embodiment 2

Figure 8:
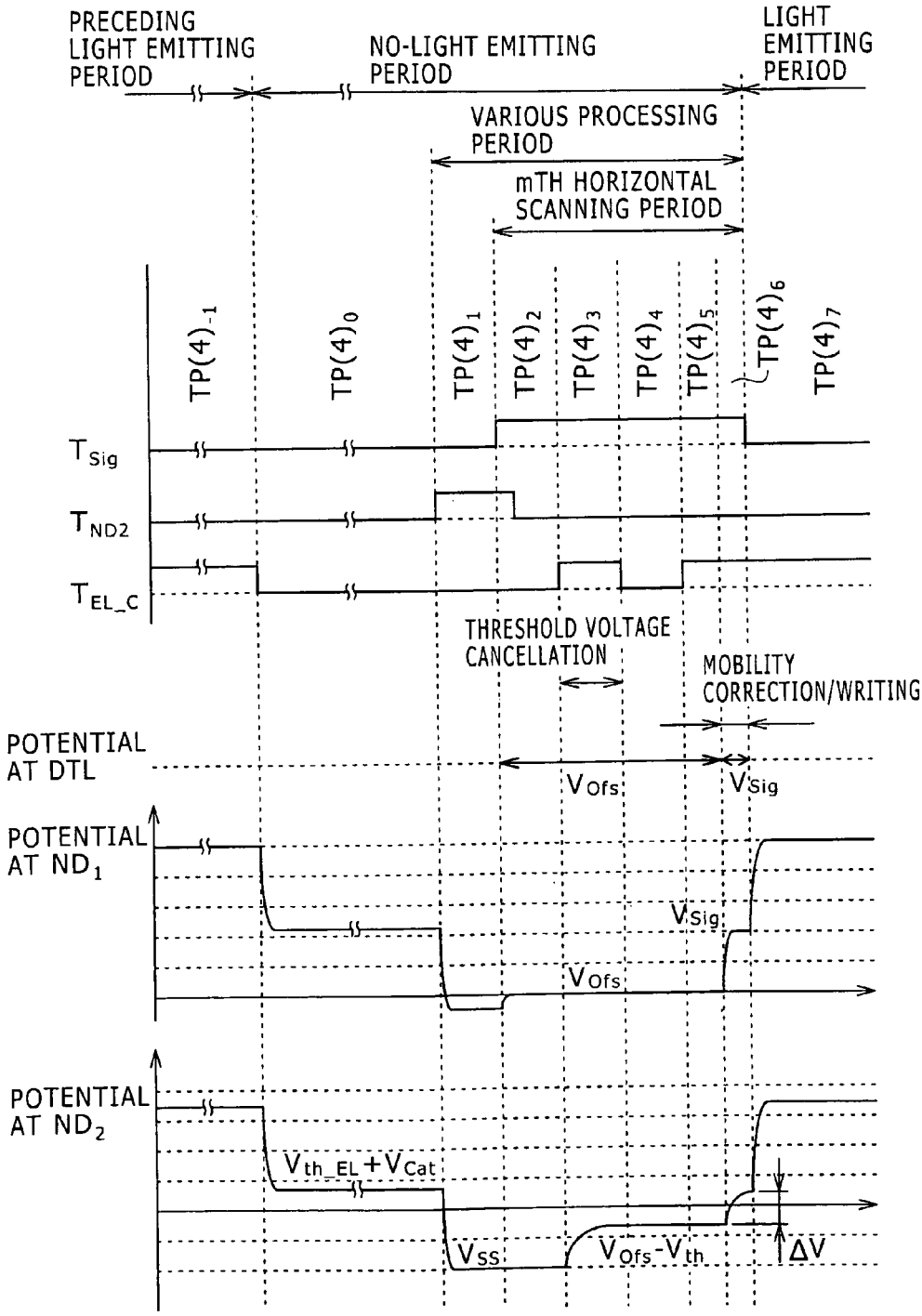
FIG. 8 is a timing chart illustrating driving of the driving circuit shown in FIG. 6.

Embodiment 2 is a modification to the embodiment 1. In embodiment 2, the driving circuit is formed from a 4Tr/1C driving circuit. An equivalent circuit diagram and a block diagram of the 4Tr/1C driving circuit are shown in FIGS. 6 and 7, respectively; a timing chart in driving of the 4Tr/1C driving circuit is shown in FIG. 8; and on/off states of transistors and so forth of the 4Tr/1C driving circuit are schematically illustrated in FIGS. 9A to 9D and 10A to 10D.

In the 4Tr/1C driving circuit, the first node initialization transistor $T_{ND1}$ is omitted from the 5Tr/1C driving circuit described hereinabove. In particular, the 4Tr/1C driving circuit includes four transistors, including an image signal writing transistor $T_{Sig}$, a driving transistor $T_{Drv}$, a light emission control transistor $T_{EL_C}$, a second node initialization transistor $T_{ND2}$, and further includes one capacitor section $C_1$.

[Light Emission Control Transistor $T_{EL_C}$]

The light emission control transistor $T_{EL_C}$ has a configuration same as that of the light emission control transistor $T_{EL_C}$ described hereinabove in the description of the 5Tr/1C driving circuit. Therefore, overlapping description of the light emission control transistor $T_{EL_C}$ is omitted herein to avoid redundancy.

[Driving Transistor $T_{Drv}$]

The driving transistor $T_{Drv}$ has a configuration same as that of the driving transistor $T_{Drv}$ described hereinabove in the description of the 5Tr/1C driving circuit. Therefore, overlapping description of the driving transistor $T_{Drv}$ is omitted herein to avoid redundancy.

[Second Node Initialization Transistor $T_{ND2}$]

The second node initialization transistor $T_{ND2}$ has a configuration the same as that of the second node initialization transistor $T_{ND2}$ described hereinabove in the description of the 5Tr/1C driving circuit. Therefore, overlapping description of the second node initialization transistor $T_{ND2}$ is omitted herein to avoid redundancy.

[Image Signal Writing Transistor $T_{Sig}$]

The image signal writing transistor $T_{Sig}$ has a configuration same as that of the image signal writing transistor $T_{Sig}$ described hereinabove in the description of the 5Tr/1C driving circuit. Therefore, overlapping description of the image signal writing transistor $T_{Sig}$ is omitted herein to avoid redundancy. It is to be noted, however, that although one of the source/drain regions of the image signal writing transistor $T_{Sig}$ is connected to the data line DTL, not only the image signal $V_{Sig}$ for controlling the luminance of the light emitting section ELP, but also the voltage $V_{Ofs}$ for initializing the gate electrode of the driving transistor $T_{Drv}$ is supplied from the image signal outputting circuit 102 to the source/drain region. In this case, the operation of the image signal writing transistor $T_{Sig}$ is different from that of the image signal writing transistor $T_{Sig}$ described hereinabove in the description of the 5Tr/1C driving circuit. It is to be noted that a signal or voltage different from the image signal $V_{Sig}$ or the voltage $V_{Ofs}$ such as, for example, a signal for precharge driving, may be supplied from the image signal outputting circuit 102 through the data line DTL to one of the source/drain regions.

[Light Emitting Section ELP]

The light emitting section ELP has a configuration same as that of the light emitting section ELP described hereinabove in the description of the 5Tr/1C driving circuit. Therefore, overlapping description of the light emitting section ELP is omitted herein to avoid redundancy.

In the following, operation of the 4Tr/1C driving circuit is described.

Figure 9A:
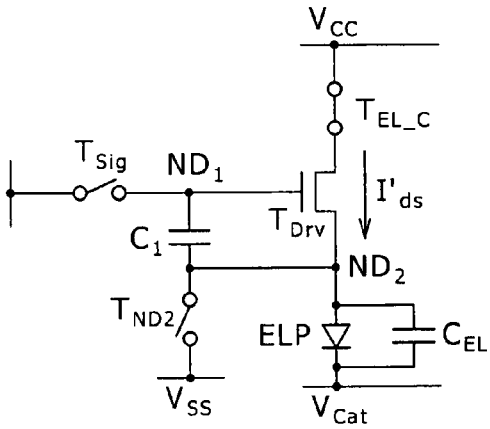
FIGS. 9A to 10D are circuit diagrams illustrating on/off states of transistors which form the driving circuit shown in FIG. 6.

[Period—TP(4)$_{-1}$] (refer to FIG. 9A)

Within this [period—TP(4)$_{-1}$], for example, operation for a preceding display frame is carried out. The operation in this instance is the same as that within the [period—TP(5)$_{-1}$], described hereinabove in the description of the 5Tr/1C driving circuit.

The periods of [period—TP(4)$_0$] to [period—TP(4)$_4$] illustrated in FIG. 8 correspond to the periods of [period—TP(5)$_0$] to [period—TP(5)$_4$] illustrated in FIG. 3, respectively, and are operation periods to a timing immediately before a next mobility correction/writing process is carried out. Similarly as in the 5Tr/1C driving circuit, the (n, m)th organic EL element 10 is in a no-light emitting state within the periods of [period—TP(4)$_0$] to [period—TP(4)$_4$]. However, the operation of the 4Tr/1C driving circuit is different from that of the 5Tr/1C driving circuit in that not only the periods of [period—TP(4)$_5$] to [period—TP(4)$_6$], but also the periods of [period—TP(4)$_2$] to [period—TP(4)$_4$] are included in the mth horizontal scanning period as illustrated in FIG. 8. It is assumed that a starting timing of the [period—TP(4)$_2$] and an ending timing of the [period—TP(4)$_6$] coincide with a starting timing and an ending timing of the mth horizontal scanning period, respectively, for the convenience of description.

In the following, operation within the periods of [period—TP(4)$_0$] to [period—TP(4)$_4$] is described. It is to be noted that the starting timing of the [period—TP(4)$_1$] and the lengths of the periods of [period—TP(4)$_1$] to [period—TP(4)$_4$] may be set suitably in accordance with the design of the organic EL display apparatus similarly as in the foregoing description of the 5Tr/1C driving circuit.

[Period—TP(4)$_0$]

Operation within this [period—TP(4)$_0$] is carried out upon transition from a preceding display frame to a current display frame and is substantially same as that within the [period—TP(5)$_0$] described hereinabove in the description of the 5Tr/1C driving circuit.

Figure 9B:
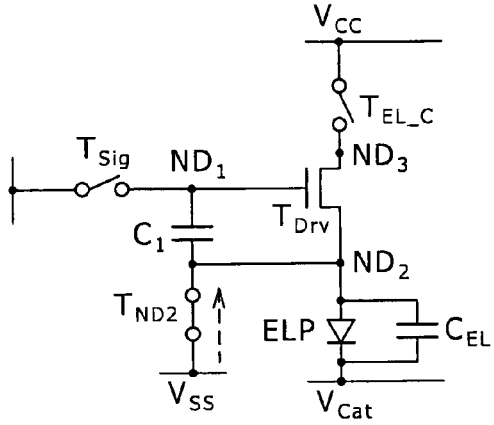

[Period—TP(4)$_1$] (refer to FIG. 9B)

This [period—TP(4)$_1$] corresponds to the [period—TP(5)$_1$] described hereinabove in the description of the 5Tr/1C driving circuit. Within the [period—TP(4)$_1$], a preprocess for carrying out a threshold voltage cancellation process described hereinafter is carried out. Upon starting of the [period—TP(4)$_1$], the second node initialization transistor control circuit 105 operates to set the second node initialization transistor control line $AZ_{ND2}$ to the high level, placing the second node initialization transistor $T_{ND2}$ into an on state. As a result, the potential at the second node $ND_2$ becomes equal to the voltage $V_{SS}$, which is, for example, −10 volts. Also, the potential at the first node $ND_1$ in a floating state, that is, at the gate electrode of the driving transistor $T_{Drv}$, drops to follow the drop of the potential at the second node $ND_2$. It is to be noted that since the potential at the first node $ND_1$ within the [period—TP(4)$_1$] depends upon the potential at the first node $ND_1$ within the [period—TP(4)$_1$], which in turn depends upon the value of the image signal $V_{Sig}$ in the preceding frame, it does not assume a fixed value.

Figure 9C:
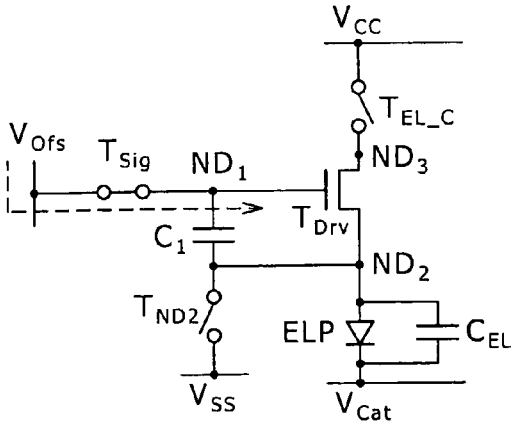

[Period—TP(4)$_2$] (refer to FIG. 9C)

Thereafter, the image signal outputting circuit 102 operates to set the potential at the data line DTL to the voltage $V_{Ofs}$, and the scanning circuit 101 operates to set the scanning line SCL to the high level, placing the image signal writing transistor $T_{Sig}$ into an on state. As a result, the potential at the first node $ND_1$ becomes equal to the voltage $V_{Ofs}$ which may be, for example, 0 volt. The potential at the second node $ND_2$ is maintained at the voltage $V_{SS}$ which may be, for example, −10 volts. Thereafter, the second node initialization transistor control circuit 105 operates to set the second node initialization transistor control line $AZ_{ND2}$ to the low level to place the second node initialization transistor $T_{ND2}$ into an off state.

It is to be noted that the image signal writing transistor $T_{Sig}$ may be placed into an on state simultaneously with starting of the [period—TP(4)$_1$] or during the [period—TP(4)$_1$].

By the processes described above, the potential difference between the gate electrode and the source region of the driving transistor $T_{Drv}$ becomes greater than the threshold voltage $V_{th}$, and the driving transistor $T_{Drv}$ is placed into an on state.

Figure 9D:
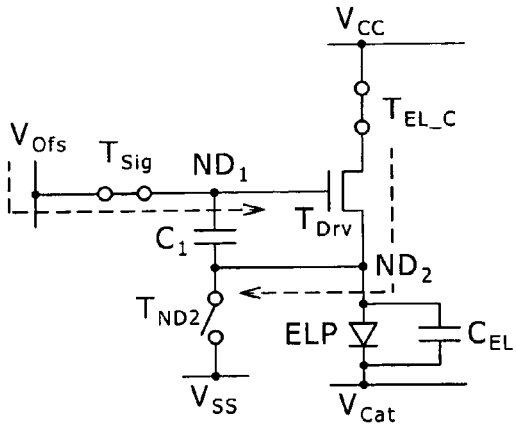

[Period—TP(4)$_3$] (refer to FIG. 9D)

Then, the threshold voltage cancellation process is carried out. In particular, while the on state of the image signal writing transistor $T_{Sig}$ is maintained, the light emission controlling transistor control circuit 103 operates to place the light emission control transistor control line $CL_{EL_C}$ into the high level, placing the light emission control transistor $T_{EL_C}$ into an on state. As a result, although the potential at the first node $ND_1$ does not vary but maintains the voltage $V_{Ofs}$=0, the potential at the second node $ND_2$ varies toward the difference of the threshold voltage $V_{th}$ of the driving transistor $T_{Drv}$ from the potential at the first node $ND_1$. In other words, the potential at the second node $ND_2$ in a floating state rises. Then, when the potential difference between the gate electrode and the source region of the driving transistor $T_{Drv}$ reaches the threshold voltage $V_{th}$, the driving transistor $T_{Drv}$ enters an off state. More particularly, the potential at the second node $ND_2$ in a floating state approaches $V_{Ofs}-V_{th}$=−3 volts and finally becomes equal to $V_{Ofs}-V_{th}$. Here, if the expression (2) given hereinabove is assured, or in other words, if the potentials are selected and determined so as to satisfy the expression (2), then the light emitting section ELP does not emit light.

Within this [period—TP(4)$_3$], the potential at the second node $ND_2$ finally becomes equal to $V_{Ofs}-V_{th}$. In other words, the potential at the second node $ND_2$ relies only upon the threshold voltage $V_{th}$ of the driving transistor $T_{Drv}$ and the voltage $V_{Ofs}$ for initializing the gate electrode of the driving transistor $T_{Drv}$. The potential at the second node $ND_2$ is then determined. Thus, the potential at the second node $ND_2$ is independent of the threshold voltage $V_{th\text{-}EL}$ of the light emitting section ELP.

Figure 10A:
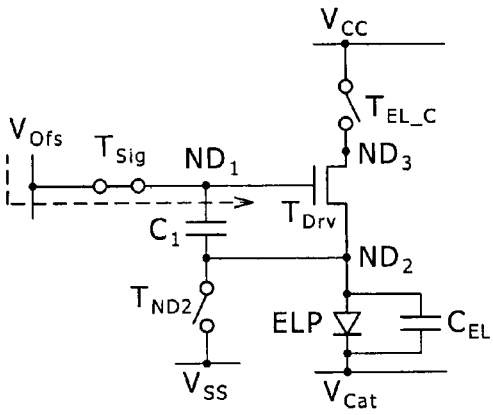

[Period—TP(4)$_4$] (refer to FIG. 10A)

Thereafter, while the on state of the image signal writing transistor $T_{Sig}$ is maintained, the light emission controlling transistor control circuit 103 operates to set the light emission control transistor control line $CL_{EL_C}$ to the low level, placing the light emission control transistor $T_{EL_C}$ into an off state. As a result, the potential at the first node $ND_1$ does not vary but maintains the voltage $V_{Ofs}$=0 volt, and the potential at the second node $ND_2$ also does not substantially vary but maintains $V_{Ofs}-V_{th}$=−3 volts. In this instance, although a potential difference may actually be caused by electrostatic coupling of a parasitic capacitance and so forth, this usually can be ignored.

Now, operation within the periods of [period—TP(4)$_5$] to [period—TP(4)$_7$] is described. Operation within those periods is substantially same as that within the periods of [period—TP(5)$_5$] to [period—TP(5)$_7$] described hereinabove in the description of the 5Tr/1C driving circuit.

Figure 10B:
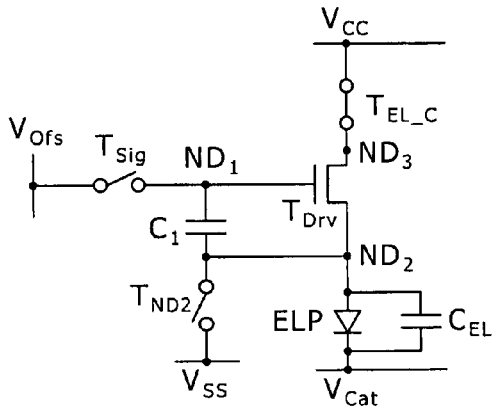

[Period—TP(4)$_5$] (refer to FIG. 10B)

Thereafter, a preprocess for the mobility correction/writing process is carried out. In particular, operation same as that within the [period—TP(5)$_5$] described hereinabove in the description of the 5Tr/1C driving circuit may be carried out. In particular, the light emission controlling transistor control circuit 103 operates to set the light emission control transistor control line $CL_{EL_C}$ to the high level, placing the light emission control transistor $T_{EL_C}$ into an on state.

Figure 10C:
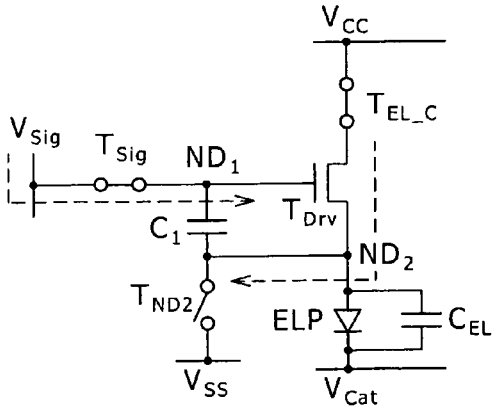

[Period—TP(4)$_6$] (refer to FIG. 10C)

Then a mobility correction process of the potential at the source region of the driving transistor $T_{Drv}$, that is, at the second node $ND_2$, based on the magnitude of the mobility μ of the driving transistor $T_{Drv}$ is carried out, and a writing process into the driving transistor $T_{Drv}$ is simultaneously executed. In other words, a mobility correction/writing process is executed. In particular, the same operation as that within the [period—TP(5)$_6$] described hereinabove in the description of the 5Tr/1C driving circuit may be executed. In particular, while the off state of the second node initialization transistor $T_{ND2}$ is maintained, the image signal outputting circuit 102 operates to change over the potential at the data line DTL from the voltage $V_{Ofs}$ to the image signal $V_{Sig}$ for controlling the luminance of the light emitting section ELP. The scanning circuit 101 then operates to set the scanning line SCL to the high level to place the image signal writing transistor $T_{Sig}$ into an on state. As a result, the potential at the first node $ND_1$ rises to the image signal $V_{Sig}$, and the potential at the second node $ND_2$ rises substantially to $V_{Ofs}-V_{th}+\Delta V$. Consequently, the potential difference between the first node $ND_1$ and the second node $ND_2$, that is, the potential difference $V_{gs}$ between the gate electrode and the source region of the driving transistor $T_{Drv}$, becomes equal to the value obtained from the expression (3) given hereinabove similarly as in the case of the 5Tr/1C driving circuit described hereinabove. It is to be noted that the total time $t_0$ of the [period—TP(4)$_6$] may be determined in advance as a design value upon designing of the organic EL display apparatus.

In other words, also in the 4Tr/1C driving circuit, the potential difference $V_{gs}$ obtained in the mobility correction/writing process for the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs}$ for initializing the gate electrode of the driving transistor $T_{Drv}$, and the increasing amount ΔV or potential correction value for the potential (which relies upon the mobility μ of the driving transistor $T_{Drv}$). In other words, the potential difference $V_{gs}$ is independent of the threshold voltage $V_{th\text{-}EL}$ of the light emitting section ELP.

Figure 10D:
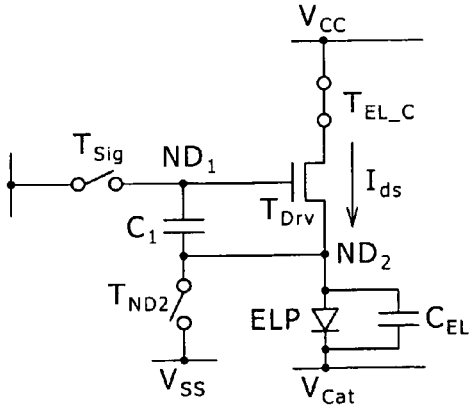

[Period—TP(4)$_7$] (refer to FIG. 10D)

The threshold voltage cancellation process and the mobility correction/writing process are completed by the operations described above. Then, a process same as that within the [period—TP(5)$_7$], described above in the description of the 5Tr/1C driving circuit, is carried out. Consequently, the potential at the second node $ND_2$ rises and exceeds $V_{th\text{-}EL}+V_{Cat}$, starting the emission of light in the light emitting section ELP. At this time, since the current flowing through the light emitting section ELP can be obtained from the expression (4) given hereinabove, the drain current $I_{ds}$ flowing through the light emitting section ELP does not rely upon any of the threshold voltage $V_{th\text{-}EL}$ of the light emitting section ELP and the threshold voltage $V_{th}$ of the driving transistor $T_{Drv}$. In other words, the emitted light amount or luminance of the light emitting section ELP is not influenced by any of the threshold voltage $V_{th\text{-}EL}$ of the light emitting section ELP and the threshold voltage $V_{th}$ of the driving transistor $T_{Drv}$. In addition, appearance of a dispersion of the drain current $I_{ds}$ arising from the dispersion of the mobility μ of the driving transistor $T_{Drv}$ can be suppressed.

Then, the light emitting state of the light emitting section ELP is continued till the (m+m'−1)th horizontal scanning period. This point of time corresponds to the end of the [period—TP(4)$_{-1}$].

The light emitting operation of the organic EL element 10, that is, the (n, m)th sub pixel or organic EL element 10, is completed therewith.

Embodiment 3

Figure 13:
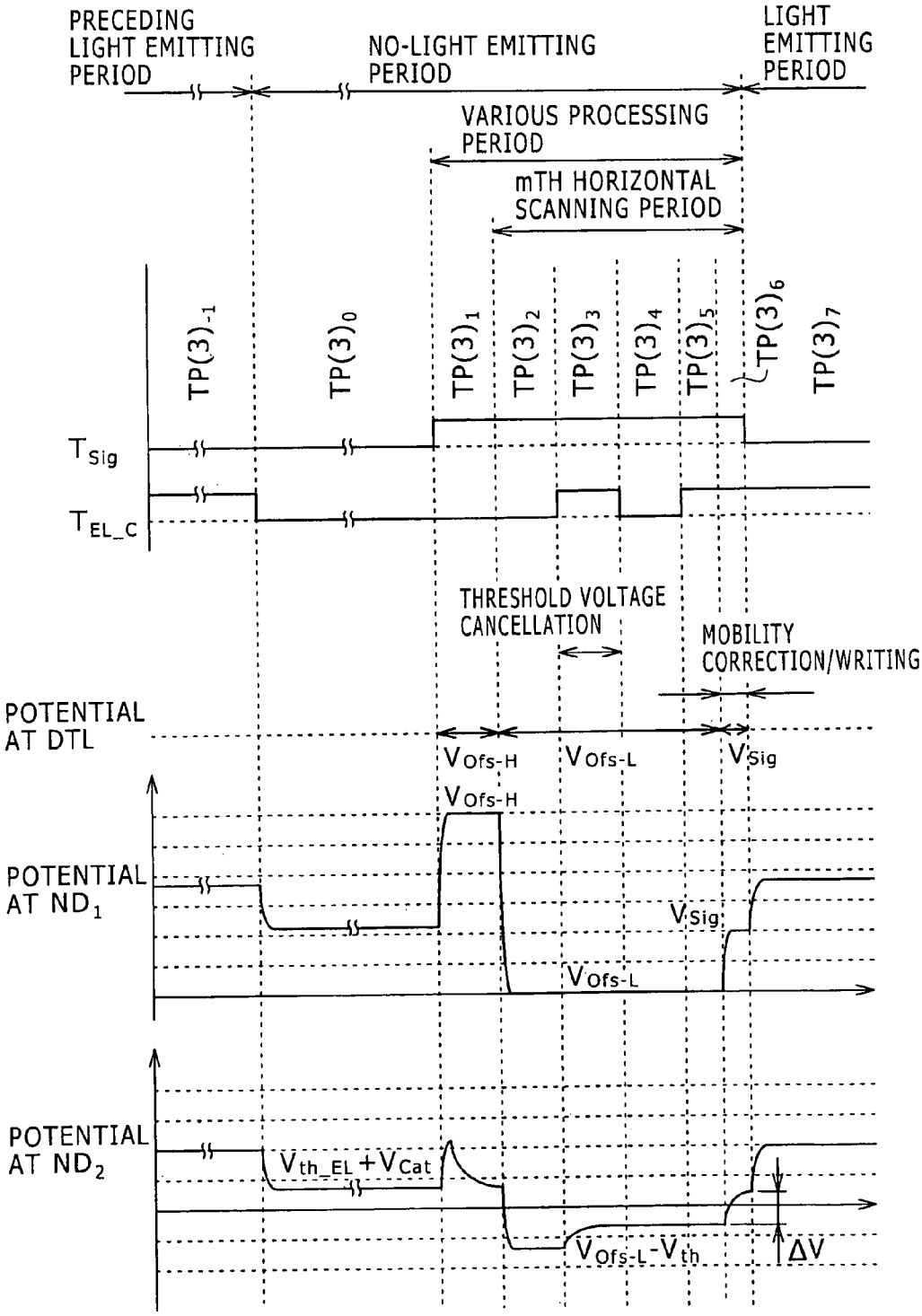
FIG. 13 is a timing chart illustrating driving of the driving circuit shown in FIG. 11.

Also, embodiment 3 is a modification to the embodiment 1. In the embodiment 3, the driving circuit is formed from a 3Tr/1C driving circuit. An equivalent circuit diagram and a block diagram of the 3Tr/1C driving circuit are shown in FIGS. 11 and 12, respectively; a timing chart in driving of the 3Tr/1C driving circuit is shown in FIG. 13; and on/off states of transistors and so forth of the 3Tr/1C driving circuit are schematically illustrated in FIGS. 14A to 14D and 15A to 15E.

In the 3Tr/1C driving circuit, two transistors including the first node initialization transistor $T_{ND1}$ and the second node initialization transistor $T_{ND2}$ are omitted from the 5Tr/1C driving circuit described hereinabove. In particular, the 3Tr/1C driving circuit includes three transistors including an image signal writing transistor $T_{Sig}$, a light emission control transistor $T_{EL_C}$, a driving transistor $T_{Drv}$, and further includes one capacitor section $C_1$.

[Light Emission Control Transistor $T_{EL_C}$]

The light emission control transistor $T_{EL_C}$ has a configuration the same as that of the light emission control transistor $T_{EL_C}$, described hereinabove in the description of the 5Tr/1C driving circuit. Therefore, overlapping description of the light emission control transistor $T_{EL_C}$ is omitted herein to avoid redundancy.

[Driving Transistor $T_{Drv}$]

The driving transistor $T_{Drv}$ has a configuration same as that of the driving transistor $T_{Drv}$, described hereinabove in the description of the 5Tr/1C driving circuit. Therefore, overlapping description of the driving transistor $T_{Drv}$ is omitted herein to avoid redundancy.

[Image Signal Writing Transistor $T_{Sig}$]

The image signal writing transistor $T_{Sig}$ has a configuration same as that of the image signal writing transistor $T_{Sig}$, described hereinabove in the description of the 5Tr/1C driving circuit. Therefore, overlapping description of the image signal writing transistor $T_{Sig}$ is omitted herein to avoid redundancy. It is to be noted, however, that, although one of the source/drain regions of the image signal writing transistor $T_{Sig}$ is connected to the data line DTL, not only the image signal $V_{Sig}$ for controlling the luminance of the light emitting section ELP, but also a voltage $V_{Ofs\text{-}H}$ for initializing the gate electrode of the driving transistor $T_{Drv}$ are supplied from the image signal outputting circuit 102 to the source/drain region. In this regard, the operation of the image signal writing transistor $T_{Sig}$ is different from that of the image signal writing transistor $T_{Sig}$ described hereinabove in the description of the 5Tr/1C driving circuit. It is to be noted that a signal or voltage different from the image signal $V_{Sig}$ or voltages $V_{Ofs\text{-}H}/V_{Ofs\text{-}L}$ such as, for example, a signal for precharge driving, may be supplied from the image signal outputting circuit 102 through the data line DTL to one of the source/drain regions. Although the values of the voltage $V_{Ofs\text{-}H}$ and the voltage $V_{Ofs\text{-}L}$ are not limited particularly, they may be, for example, $V_{Ofs\text{-}H}$=approximately 30 volts $V_{Ofs\text{-}L}$=approximately 0 volt

[Relationships of the Values of the Parasitic Capacitance $C_{EL}$ and the Capacitance $C_1$]

As hereinafter described, in the 3Tr/1C driving circuit, it is necessary to utilize the data line DTL to vary the potential at the second node $ND_2$. It is described in the description of the 5Tr/1C driving circuit and the 4Tr/1C driving circuit that the parasitic capacitance $C_{EL}$ has a sufficiently high value when compared with the value $c_1$ and the value $c_{gs}$. The variation of the potential in the source region of the driving transistor $T_{Drv}$, that is, at the second node $ND_2$, based on the variation $V_{Sig}-V_{Ofs}$ of the potential at the gate electrode of the driving transistor $T_{Drv}$ is not taken into consideration. On the other hand, in the 3Tr/1C driving circuit, the value $c_1$ is set to a value higher than those of the other driving circuits, for example, to approximately ¼ to ⅓ of the parasitic capacitance $C_{EL}$, depending upon the design. Accordingly, the degree of the potential variation at the second node $ND_2$, which arises from the potential variation at the first node $ND_1$, is higher than those of the other driving circuits. Therefore, in the following description of the 3Tr/1C driving circuit, the potential variation at the second node $ND_2$ arising from the potential variation of the first node $ND_1$ is taken into consideration. It is to be noted that also the driving timing chart is given taking the potential variation at the second node $ND_2$ caused by the potential variation at the first node $ND_1$ into consideration.

[Light Emitting Section ELP]

The light emitting section ELP has a configuration same as that of the light emitting section ELP, described hereinabove in the description of the 5Tr/1C driving circuit. Therefore, overlapping description of the light emitting section ELP is omitted herein to avoid redundancy.

In the following, operation of the 3Tr/1C driving circuit is described.

Figure 14A:
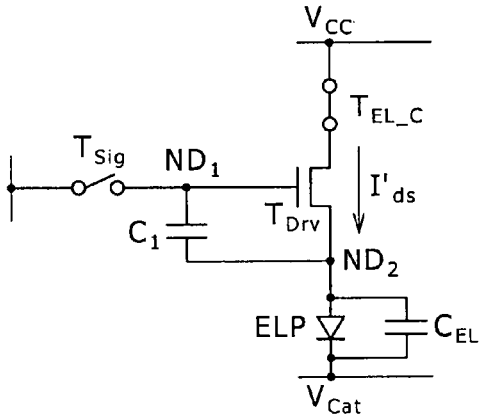
FIGS. 14A to 15E are circuit diagrams illustrating on/off states of transistors, which form the driving circuit shown in FIG. 11.

[Period—TP(3)$_{-1}$] (refer to FIG. 14A)

Within this [period—TP(3)$_{-1}$], for example, operation for a preceding display frame is carried out.

The operation within the period is same as that within the [period—TP(5)$_{-1}$], described hereinabove in the description of the 5Tr/1C driving circuit.

The periods of [period—TP(3)$_0$] to [period—TP(3)$_4$] illustrated in FIG. 13 correspond to the periods of [period—TP(5)$_0$] to [period—TP(5)$_4$] illustrated in FIG. 3, respectively, and are operation periods to a timing immediately before a succeeding mobility correction/writing process is carried out. Similarly as in the 5Tr/1C driving circuit, the (n, m)th organic EL element 10 is in a no-light emitting state within the periods of [period—TP(3)$_0$] to [period—TP(3)$_4$]. However, the operation of the 3Tr/1C driving circuit is different from that of the 5Tr/1C driving circuit, in that not only the periods of [period—TP(3)$_5$] to [period—TP(3)$_6$], but also the periods of [period—TP(3)$_1$] to [period—TP(3)$_4$] are included in the mth horizontal scanning period as seen in FIG. 13. It is assumed that a starting timing of the [period—TP(3)$_1$] and an ending timing of the [period—TP(3)$_6$] coincide with a starting timing and an ending timing of the mth horizontal scanning period, respectively, for the convenience of description.

In the following, operation within the periods of [period—TP(3)$_0$] to [period—TP(3)$_4$] is described. It is to be noted that the lengths of the periods of [period—TP(3)$_1$] to [period—TP(3)$_4$] may be set suitably in accordance with the design of the organic EL display apparatus, similar to the foregoing description of the 5Tr/1C driving circuit.

Figure 14B:
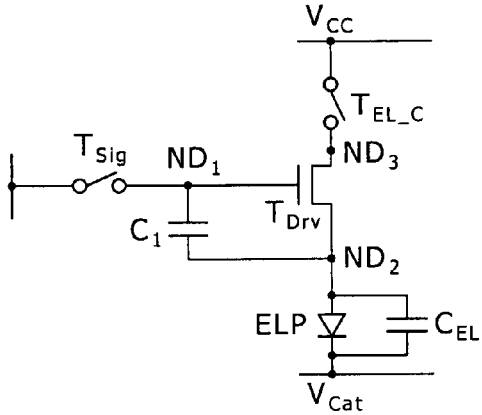

[Period—TP(3)$_0$] (refer to FIG. 14B)

Operation within this [period—TP(3)$_0$] is carried out upon transition from a preceding display frame to a current display frame, and is substantially the same as that within the [period—TP(5)$_0$] described hereinabove in the description of the 5Tr/1C driving circuit.

Figure 14C:
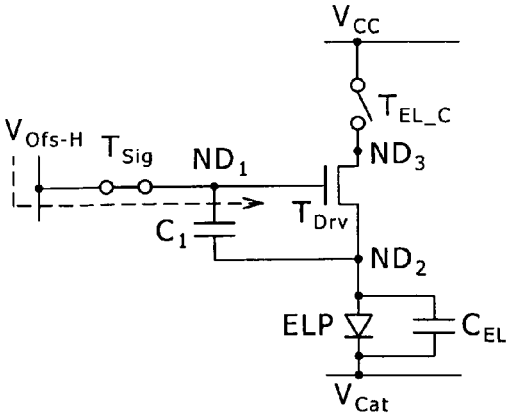

[Period—TP(3)$_1$] (refer to FIG. 14C)

Then, the mth horizontal scanning period in the current display frame starts. Upon starting of the [period—TP(3)$_1$], the image signal outputting circuit 102 operates to set the potential at the data line DTL to the voltage $V_{Ofs\text{-}H}$ for initializing the gate electrode of the driving transistor $T_{Drv}$, and then the scanning circuit 101 operates to set the scanning line SCL to the high level, placing the image signal writing transistor $T_{Sig}$ into an on state. As a result, the potential at the first node $ND_1$ becomes equal to the voltage $V_{Ofs\text{-}H}$. Since the value $c_1$ of the capacitor section $C_1$ is set higher than those of the other driving circuits depending upon the design as described above, the potential in the source region of the driving transistor $T_{Drv}$, that is, the potential at the second node $ND_2$, rises. Then, since the potential difference across the light emitting section ELP finally exceeds the threshold voltage $V_{th\text{-}EL}$, the light emitting section ELP is placed into a conducting state. However, the potential in the source region of the driving transistor $T_{Drv}$ immediately drops to $V_{th\text{-}EL}+V_{Cat}$ again. It is to be noted that, within this process, although the light emitting section ELP can emit light, such light emission occurring at the moment does not matter in practical use. On the other hand, the gate electrode of the driving transistor $T_{Drv}$ maintains the voltage $V_{Ofs\text{-}H}$.

Figure 14D:
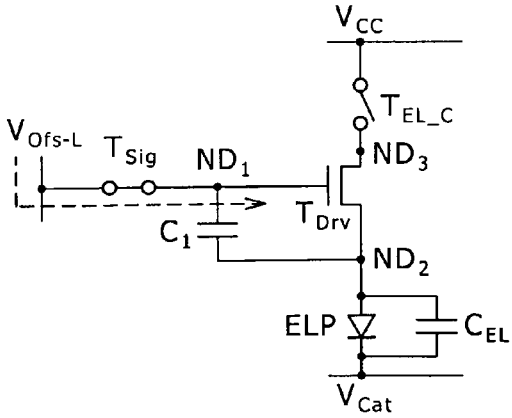

[Period—TP(3)$_2$] (refer to FIG. 14D)

Thereafter, the image signal outputting circuit 102 operates to set the potential at the data line DTL from the voltage $V_{Ofs\text{-}H}$ for initializing the gate electrode of the driving transistor $T_{Drv}$ to the voltage $V_{Ofs\text{-}L}$, and consequently, the potential at the first node $ND_1$ becomes equal to the voltage $V_{Ofs\text{-}L}$. Then, together with the drop of the potential at the first node $ND_1$, the potential at the second node $ND_2$ also drops. In particular, charge based on the variation $V_{Ofs\text{-}L}-V_{Ofs\text{-}H}$ of the potential at the gate electrode of the driving transistor $T_{Drv}$ is distributed to the capacitor section $C_1$, the parasitic capacitance $C_{EL}$ of the light emitting section ELP and the parasitic capacitance between the gate electrode and the source region of the driving transistor $T_{Drv}$. It is to be noted that, as a prerequisite for operation within the [period—TP(3)$_3$] hereinafter described, it is necessary for the potential at the second node $ND_2$ to be lower than $V_{Ofs\text{-}L}-V_{th}$ at an ending timing of the [period—TP(3)$_2$]. The values of the voltage $V_{Ofs\text{-}H}$ and so forth are set so as to satisfy this requirement. Thus, by the process described above, the potential difference between the gate electrode and the source region of the driving transistor $T_{Drv}$ becomes greater than the threshold voltage $V_{th}$, and consequently, the driving transistor $T_{Drv}$ is placed into an on state.

Figure 15A:
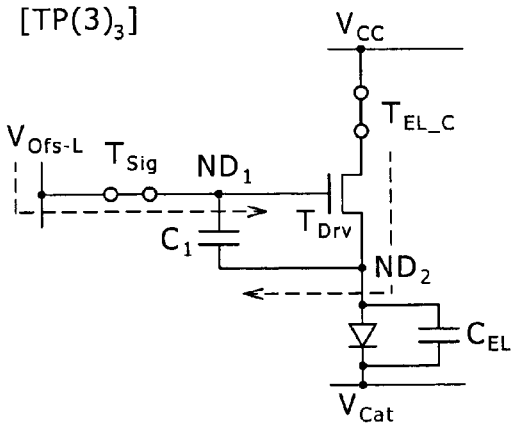

[Period—TP(3)$_3$] (refer to FIG. 15A)

Then, the threshold voltage cancellation process is carried out. In particular, while the on state of the image signal writing transistor $T_{Sig}$ is maintained, the light emission controlling transistor control circuit 103 operates to place the light emission control transistor control line $CL_{EL_C}$ into the high level, placing the light emission control transistor $T_{EL_C}$ into an on state. As a result, although the potential at the first node $ND_1$ does not vary but maintains the voltage $V_{Ofs\text{-}L}=0$, the potential at the second node $ND_2$ varies from the potential at the first node $ND_1$ toward the difference of the threshold voltage $V_{th}$ of the driving transistor $T_{Drv}$. In other words, the potential at the second node $ND_2$ in a floating state rises. Then, when the potential difference between the gate electrode and the source electrode of the driving transistor $T_{Drv}$ reaches the threshold voltage $V_{th}$, the driving transistor $T_{Drv}$ enters an off state. More particularly, the potential at the second node $ND_2$ in a floating state approaches $V_{Ofs\text{-}L}-V_{th}=-3$ volts and finally becomes equal to $V_{Ofs\text{-}L}-V_{th}$. Here, if the expression (2) given hereinabove is assured, or in other words, if the potentials are selected and determined so as to satisfy the expression (2), then the light emitting section ELP does not emit light.

Within this [period—TP(3)$_3$], the potential at the second node $ND_2$ finally becomes equal to $V_{Ofs\text{-}L}-V_{th}$. In other words, the potential at the second node $ND_2$ relies only upon the threshold voltage $V_{th}$ of the driving transistor $T_{Drv}$ and the voltage $V_{Ofs\text{-}L}$ for initializing the gate electrode of the driving transistor $T_{Drv}$. The potential at the second node $ND_2$ is then determined. In other words, the potential at the second node $ND_2$ is independent of the threshold voltage $V_{th\text{-}EL}$ of the light emitting section ELP.

Figure 15B:
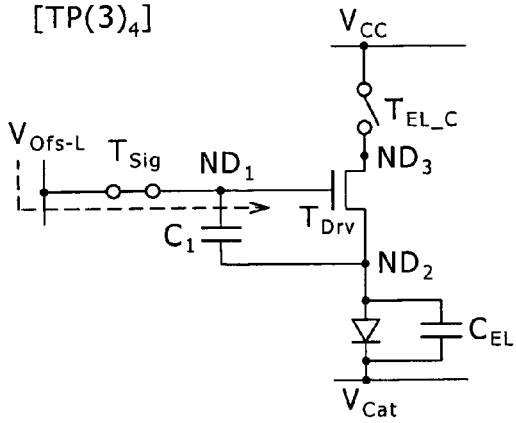

[Period—TP(3)$_4$] (refer to FIG. 15B)

Thereafter, while the on state of the image signal writing transistor $T_{Sig}$ is maintained, the light emission controlling transistor control circuit 103 operates to set the light emission control transistor control line $CL_{EL_C}$ to the low level, placing the light emission control transistor $T_{EL_C}$ into an off state. As a result, the potential at the first node $ND_1$ does not vary but maintains the voltage $V_{Ofs\text{-}L}=0$ volt, and the potential at the second node $ND_2$ also does not substantially vary but maintains $V_{Ofs\text{-}L}-V_{th}=-3$ volts.

Now, operation within the periods of [period—TP(3)$_5$] to [period—TP(3)$_7$] is described. Operation within those periods is substantially same as that within the [period—TP(5)$_5$] to [period—TP(5)$_7$] described hereinabove in the description of the 5Tr/1C driving circuit.

Figure 15C:
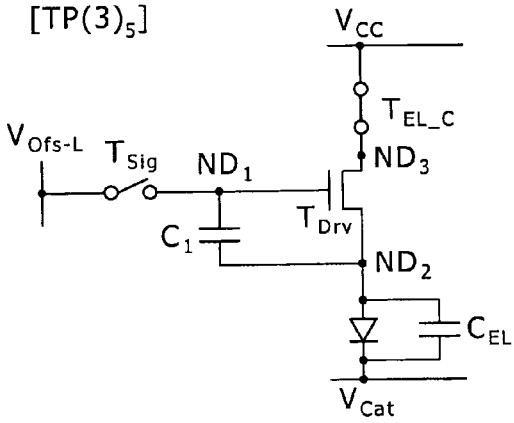

[Period—TP(3)$_5$] (refer to FIG. 15C)

Thereafter, a preprocess for the mobility correction/writing process is carried out. In particular, operation same as that within the [period—TP(5)$_5$] described hereinabove in the description of the 5Tr/1C driving circuit may be carried out. In particular, the light emission controlling transistor control circuit 103 operates to set the light emission control transistor control line $CL_{EL_C}$ to the high level to place the light emission control transistor $T_{EL_C}$ into an on state.

Figure 15D:
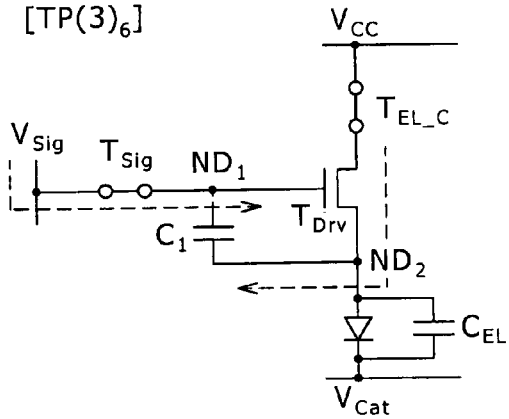

[Period—TP(3)$_6$] (refer to FIG. 15D)

Then a mobility correction process of the potential at the source region of the driving transistor $T_{Drv}$, that is, at the second node $ND_2$, based on the magnitude of the mobility $\mu$ of the driving transistor $T_{Drv}$ is carried out, and, a writing process into the driving transistor $T_{Drv}$ is simultaneously executed. In other words, a mobility correction/writing process is executed. In particular, operation same as that within the [period—TP(5)$_6$], described hereinabove in the description of the 5Tr/1C driving circuit may be executed. It is to be noted that the predetermined time for executing the mobility correction/writing process, that is, the total time to of the [period—TP(3)$_6$] may be determined in advance as a design value upon designing of the organic EL display apparatus. As a result of the processes, the potential at the first node $ND_1$ rises to the image signal voltage $V_{Sig}$, and the potential at the second node $ND_2$ rises substantially to $V_{Ofs}-V_{th}+\Delta V$. Consequently, the potential difference between the first node $ND_1$ and the second node $ND_2$, that is, the potential difference $V_{gs}$ between the gate electrode and the source region of the driving transistor $T_{Drv}$, becomes equal to the value obtained from the expression (3) given hereinabove, similar to the 5Tr/1C driving circuit described hereinabove.

In other words, also in the 3Tr/1C driving circuit, the potential difference $V_{gs}$ obtained in the mobility correction/writing process for the driving transistor $T_{Drv}$ relies only upon the image signal $V_{Sig}$ for controlling the luminance of the light emitting section ELP, the threshold voltage $V_{th}$ of the driving transistor $T_{Drv}$, the voltage $V_{Ofs-L}$ for initializing the gate electrode of the driving transistor $T_{Drv}$, and the increasing amount $\Delta V$ or potential correction value for the potential (which relies upon the mobility $\mu$ of the driving transistor $T_{Drv}$). In other words, the potential difference $V_{gs}$ is independent of the threshold voltage $V_{th-EL}$ of the light emitting section ELP.

Figure 15E:
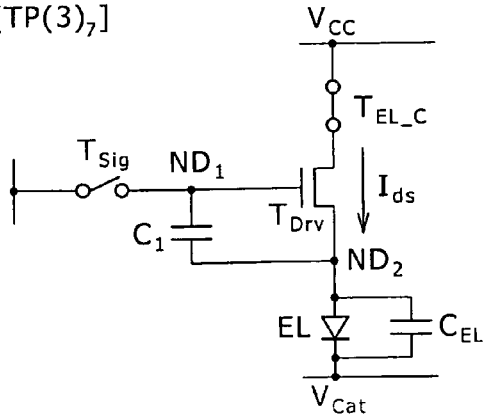

[Period—TP(3)$_7$] (refer to FIG. 15E)

The threshold voltage cancellation process and the mobility correction/writing process are completed by the operations described above. Then, a process the same as that within the [period—TP(5)$_7$] described above in the description of the 5Tr/1C driving circuit is carried out. Consequently, since the potential at the second node $ND_2$ rises and exceeds $V_{th-EL}+V_{Cat}$, the light emitting section ELP starts emission of light. At this time, since the current flowing through the light emitting section ELP can be obtained from the expression (4) given hereinabove, the drain current $I_{ds}$ flowing through the light emitting section ELP does not rely upon any of the threshold voltage $V_{th-EL}$ and the threshold voltage $V_{th}$ of the driving transistor $T_{Drv}$. In other words, the emitted light amount or luminance of the light emitting section ELP is not influenced by any of the threshold voltage $V_{th-EL}$ of the light emitting section ELP and the threshold voltage $V_{th}$ of the driving transistor $T_{Drv}$. In addition, appearance of a dispersion of the drain current $I_{ds}$ arising from the dispersion of the mobility $\mu$ of the driving transistor $T_{Drv}$ can be suppressed.

Then, the light emitting state of the light emitting section ELP is continued till the (m+m'−1)th horizontal scanning period. This point of time corresponds to the end of the [period—TP(3)$_{-1}$].

The light emitting operation of the organic EL element 10, that is, the (n, m)th sub pixel or organic EL element 10, is completed therewith.

It should be understood by those skilled in the art that various modifications, combinations, subcombinations and alterations may occur depending on design requirements and other factors insofar as they are within the scope of the appended claims or the equivalents thereof.

What is claimed is:

1. A method for driving an organic electroluminescence light emitting section using a driving circuit, the driving circuit including a driving transistor including source/drain regions, a channel formation region, and a gate electrodes;

an image signal writing transistor including source/drain regions, a channel formation region, and a gate electrode;

a light emission control transistor including source/drain regions, a channel formation region, and a gate electrode; and a capacitor section having a pair of electrodes, the driving transistor being configured such that a first one of the source/drain regions is connected to a second one of the source/drain regions of the light emission control transistor, that a second one of the source/drain regions is connected to an anode electrode provided in the organic electroluminescence light emitting section and is connected to a first one of the electrodes of the capacitor section to form a second node, and that the gate electrode is connected to a second one of the source/drain regions of the image signal writing transistor and is connected to a second one of the electrodes of the capacitor section to form a first node, the image signal writing transistor being configured such that a first one of the source/drain regions is connected to a data line, and that the gate electrode is connected to a scanning line, the light emission control transistor being configured such that a first one of the source/drain regions is connected to a current supplying section, and that the gate electrode is connected to a light emission control transistor control line, the method comprising:

carrying out a preprocess of applying a first node initialization voltage to the first node and applying a second node initialization voltage to the second node so that a potential difference between the first and second nodes exceeds a threshold voltage of the driving transistor and a potential difference between a cathode electrode of the organic electroluminescence light emitting section and the second node does not exceed a threshold voltage of the organic electroluminescence light emitting section;

carrying out a threshold voltage cancellation process for varying the potential at the second node toward a potential of the difference of the threshold voltage of the driving transistor from the potential at the first node while the potential at the first node is maintained;

placing the light emission control transistor into an on state with a signal from the light emission control transistor control line and carrying out, while the on state of the light emission control transistor is maintained, a writing process of applying an image signal from the data line to the first node through the image signal writing transistor which is placed into an on state with a signal from the scanning line; and placing the image signal writing transistor into an off state with a signal from the scanning line to place the first node into a floating state so that current corresponding to the value of the potential difference between the first and second nodes is supplied to the organic electroluminescence light emitting section from the current supplying section through the driving transistor to drive the organic electroluminescence light emitting section.

2. The method for driving the organic electroluminescence light emitting section according to claim 1, wherein the driving circuit further includes a second node initialization transistor including source/drain regions, a channel formation region, and a gate electrode, in the second node initialization transistor:

a first one of the source/drain regions is connected to a second node initialization voltage supply line;

a second one of the source/drain regions is connected to the second node; and the gate electrode is connected to a second node initialization transistor control line;

wherein carrying out said preprocess comprises applying a second node initialization voltage from the second node initialization voltage supply line to the second node through the second node initialization transistor which is placed in an on state with a signal from the second node initialization transistor control line; and placing the second node initialization transistor into an off state with a signal from the second node initialization transistor control line.

3. The method for driving the organic electroluminescence light emitting section according to claim 2, wherein the driving circuit further includes a first node initialization transistor including source/drain regions, a channel formation region, and a gate electrode, in the first node initialization transistor:

a first one of the source/drain regions is connected to a first node initialization voltage supply line;

a second one of the source/drain regions is connected to the first node; and the gate electrode is connected to the first node initialization control line;

wherein carrying out said preprocess further comprises applying a first node initialization voltage from the first node initialization voltage supply line to the first node through the first node initialization transistor which is placed in an on state with a signal from the first node initialization transistor control line.

* * * * *